US010682649B2

(12) United States Patent
Morrow et al.

(10) Patent No.: US 10,682,649 B2
(45) Date of Patent: Jun. 16, 2020

(54) DISCHARGE GRATES FOR REDUCTION MILLS

(71) Applicant: ESCO Corporation, Portland, OR (US)

(72) Inventors: Daniel R. Morrow, Portland, OR (US); Michael R. Weeks, Portland, OR (US); Lonny V. Morgan, Battle Ground, WA (US)

(73) Assignee: ESCO GROUP LLC, Portland, OR (US)

( * ) Notice: Subject to any disclaimer, the term of this patent is extended or adjusted under 35 U.S.C. 154(b) by 1057 days.

(21) Appl. No.: 14/248,107

(22) Filed: Apr. 8, 2014

(65) Prior Publication Data

US 2014/0299689 A1 Oct. 9, 2014

Related U.S. Application Data

(60) Provisional application No. 61/809,957, filed on Apr. 9, 2013.

(51) Int. Cl.

| | |
|---|---|
| ***B02C 13/04*** | (2006.01) |
| ***B02C 13/284*** | (2006.01) |
| ***B02C 13/286*** | (2006.01) |
| ***B02C 19/00*** | (2006.01) |

(52) U.S. Cl.

CPC ..... *B02C 13/284* (2013.01); *B02C 13/04* (2013.01); *B02C 13/286* (2013.01); *B02C 19/0062* (2013.01); *B02C 2013/28609* (2013.01)

(58) Field of Classification Search

CPC ..... B02C 23/08; B02C 23/10; B02C 23/16; B02C 13/284; B02C 13/04; B02C 13/286; B02C 19/0062; B02C 2013/28609; B02C 23/14; B02C 2023/165; B07B 1/00

USPC ..... 241/43, 73, 88.4; 209/274

See application file for complete search history.

(56) References Cited

U.S. PATENT DOCUMENTS

| | | | | |
|---|---|---|---|---|
| 658,288 | A | 9/1900 | Shaw et al. | |
| 763,639 | A | 6/1904 | Schoellhorn et al. | |
| 916,697 | A | 3/1909 | Gruendier | |
| 1,355,335 | A | 10/1920 | Hasendahl | |
| 1,571,675 | A | 2/1926 | Knight | |
| 1,746,512 | A * | 2/1930 | Anderson | B02C 13/284 241/86 |
| 2,141,664 | A | 12/1938 | Ossing | |
| 2,411,302 | A | 11/1946 | Stine et al. | |
| 2,563,958 | A | 8/1951 | Pollitz | |
| 2,666,589 | A | 1/1954 | Danyluke | |
| 3,465,973 | A | 9/1969 | Williams | |
| 3,591,096 | A * | 7/1971 | DeFeo | B02C 13/284 241/84.3 |
| 3,617,007 | A | 11/1971 | Bonarrigo | |

(Continued)

FOREIGN PATENT DOCUMENTS

WO WO 2012/069222 5/2012

OTHER PUBLICATIONS

List of second moments of area—Wikipedia, Nov. 2016.*

*Primary Examiner* — Adam J Eiseman
*Assistant Examiner* — Bobby Yeonjin Kim
(74) *Attorney, Agent, or Firm* — Steven Schad

(57) ABSTRACT

Discharge grates and grate components of reducing equipment have reduced amounts of material to provide lower costs, lower weight, and less scrap while still providing adequate resistance to bending, deflection, and/or warping and suitable material discharge.

20 Claims, 13 Drawing Sheets

(56) References Cited

U.S. PATENT DOCUMENTS

| | | | | | |
|---|---|---|---|---|---|
| 3,722,805 | A | * | 3/1973 | Strom | B02C 13/284 241/189.1 |
| 3,806,048 | A | | 4/1974 | Williams | |
| RE28,368 | E | | 3/1975 | Bonarrigo, Jr. | |
| 3,891,152 | A | | 6/1975 | Guggenheimer | |
| 3,934,499 | A | | 1/1976 | Strom | |
| 4,002,302 | A | | 1/1977 | Miller | |
| 4,009,836 | A | | 3/1977 | Strom et al. | |
| 4,015,783 | A | * | 4/1977 | Miller | B02C 13/284 241/73 |
| 4,061,277 | A | | 12/1977 | Whitney | |
| 4,146,184 | A | | 3/1979 | Whitney | |
| 4,226,375 | A | | 10/1980 | Cameron | |
| 4,339,085 | A | | 7/1982 | Williams | |
| 4,363,452 | A | * | 12/1982 | Nagy | B02C 17/02 241/284 |
| 4,706,898 | A | * | 11/1987 | Schonfeld | B02C 13/284 241/189.1 |
| 4,767,066 | A | | 8/1988 | Williams | |
| 4,830,291 | A | | 5/1989 | Williams | |
| 4,919,344 | A | | 4/1990 | McKie | |
| 5,018,674 | A | | 5/1991 | Williams | |
| 5,125,585 | A | | 6/1992 | Williams | |
| 5,904,306 | A | | 5/1999 | Elliott et al. | |
| 8,245,961 | B2 | | 8/2012 | Vroom et al. | |
| 9,254,492 | B2 | * | 2/2016 | Gardner | B07B 1/185 |
| 2003/0173434 | A1 | | 9/2003 | Poland et al. | |
| 2013/0240651 | A1 | * | 9/2013 | Kohl | B02C 13/284 241/79.2 |
| 2014/0150524 | A1 | * | 6/2014 | Magne | B02C 17/1805 73/1.82 |
| 2016/0008819 | A1 | * | 1/2016 | Meeuwsen | B02C 13/284 241/86.2 |

* cited by examiner

DISCHARGE GRATES FOR REDUCTION MILLS

RELATED APPLICATION

This application claims priority benefits to U.S. Provisional Patent Application No. 61/809,957 filed Apr. 9, 2013 and entitled "Discharge Grates For Reduction Mills," which is incorporated herein by reference in its entirety.

FIELD OF THE INVENTION

The present invention relates generally to reduction mills, such as crushers, grinders, shredders, pulverizers, and the like, that reduce materials to relatively small fragments to facilitate handling and subsequent processing. More particular aspects of this invention relate to discharge grates and discharge grate components or panels for reduction mills.

BACKGROUND

Industrial shredding equipment is known and used, for example, in the recycling industry, to break apart large objects into smaller pieces that can be more readily processed. In addition to shredding material like rubber (e.g., car tires), wood, and paper, commercial shredding systems are available that can shred large ferrous materials, such as scrap metal, automobiles, automobile body parts, and the like.

FIG. 1A generally illustrates an example shredding system 100 as is known and in use in the art, and FIG. 16 illustrates a more detailed view of a conventional shredding head or rotors that may be used in such a shredding system. More specifically, as shown in FIG. 1A, this example shredding system 100 includes a material inlet system (such as chute 102) that introduces the material 104 to be shredded to the shredding chamber 106. The material 104 to be shredded may be of any desired size or shape, and, if desired, it may be heated, cooled, crushed, baled, or otherwise pretreated prior to introduction into the shredding chamber 106. If necessary or desired, the inlet system 102 may include feed rollers or other machinery to help push or control the rate at which the material 104 enters into the chamber 106, to help hold the material 104 against an anvil 108, and/or to help keep the material 104 from moving backward up the chute 102. A disc rotor is shown, however, other rotors, such as spider and barrel, are also commonly used, and this invention may be equally useful with those types of rotors.

A rotary shredding head 110 (rotatable about axis or shaft 110A) is mounted in the shredding chamber 106. As the head 110 rotates, the shredding hammers 112 extend outward and away from the rotational axis 110A of the head 110 due to centrifugal force (as shown in FIG. 1A). As they rotate, the shredder hammers 112 impact the material 104 to be shredded between the hammer 112 and the anvil 108 (or other hardened surface provided within the shredding system 100) in order to break apart the material 104. The construction of one conventional shredding head 110 will be described in more detail below in conjunction with FIG. 16. As the material 104 is shredded, it may be discharged from the shredding chamber 106 through one of the outlets 114*a* provided in a discharge grate 114 located along the bottom and side of the chamber 106 walls, and transported in some manner (generally shown by arrows 116, such as via gravity, via conveyors, via truck or other vehicle, etc.) for further processing (e.g., further recycling, reclamation, separation, or other processing).

FIG. 1B provides a more detailed view of an example shredding head 110 that may be used in the shredding system 100 of FIG. 1A. This example shredding head 110 is made from multiple rotor disks 120 that are separated from one another by spacers 122 mounted around the drive shaft 110A. While any number of rotor disks 120 may be provided in a shredding head 110 (e.g., 8-16), this illustrated example includes seven disks 120 (the end disk 120 is omitted from FIG. 16 to better show the details of the underlying structures). The disks 120 may be fixedly mounted with respect to the shaft 110A (e.g., by welding, mechanical connectors, etc.) to allow the disks 120 to be rotated when the shaft 110A is rotated (e.g., by an external motor or other power source, not shown). In addition to providing a spacing function, spacers 122 can help protect the shaft 110A from undesired damage, e.g., due to contact with material 104 being shredded, broken parts of a shredder hammer 112, etc.

Hammer pins 124 extend between at least some of the rotor disks 120 (more commonly, between several disks 120 and/or through the entire length of the head 110), and the shredder hammers 112 are rotatably mounted on and are rotatable with respect to these pins 124. More specifically, as shown in FIG. 1B, a hammer pin 124 extends through an opening 112A provided in the mounting portion 112F of the shredder hammer 112, and the shredder hammer 112 is capable of rotating around this pin 124. In this illustrated example, the shredding head 110 includes six hammer pins 124 around the circumference of the rotor disks 120, and a single shredder hammer 112 is provided on each pin 124 between two adjacent rotor disks 120 (such that each hammer pin 124 includes a single shredder hammer 112 mounted thereon and such that the shredder hammers 112 are staggeringly distributed along the longitudinal length of the head 110). This hammer pattern may be modified as required by the end user, depending on their needs. At locations between rotor disks 120 where no shredder hammer 112 is provided on a particular hammer pin 124, the pin 124 may be covered with a pin protector 126, to protect the pin structure 124 from contact with and damage caused by the material 104 being shredded. These pin protectors 126 may be of any desired size and/or shape.

In use, the rotor disks 120 are rotated as a unit with shaft 110A, e.g., by an external motor or other power source (not shown). The centrifugal force associated with this rotation causes the shredder hammers 112 to rotate about their respective pins 124 to extend their heavier blade ends 112E outward and away from the shaft 110A, as shown in FIG. 1A. As the rotation continues, the shredder hammer 112 will contact the material 104 to be shredded. Because it is rotatably mounted on the hammer pin 124, contact with the material 104 to be shredded may cause the shredder hammer 112 to slow down or even rotate in the opposite direction as it smashes the material 104 to be shredded against the anvil 108. The pins 124, pin protectors 126, hammers 112, spacers 122, and rotor disks 120 may be structured and arranged so that, in the event that a shredder hammer 112 is unable to completely pass through the material 104, it can rotate to a location between adjacent plates 120 and thereby pass by the material 104 until it is able to extend outward again under the centrifugal force due to rotation of the shredder head 110 about shaft 110A for the next collision. Also, in some instances, the shredder hammer 112 will shift sideways on its pin 124 as it passes by or through the material to be shredded.

If desired, the various parts of the shredder head 110 may be shaped and oriented with respect to one another such that a shredder hammer 112 can rotate 360° around its pin 124 without contacting another pin 124, a pin protector 126, the drive shaft 110A, another hammer 112, etc. Shredding systems and heads of the types described above are known and used in the art.

Thus, as described above, the reduction (e.g., shredding) is achieved by introducing the material 104 to be shredded into the path of the rotating hammers 112 (located within a drum or housing), and the accompanying impact with the hammers 112 alone is enough to achieve at least partial reduction. Further reduction may occur as the hammers 112 force the material 104 across and through the discharge grate 114. The discharge grate 114 is webbed or has a sieve-like structure including a plurality of discharge openings 114*a*. The openings 114*a* in grate 114 can be of any pattern, but conventionally the openings 114*a* are aligned in both circumferential and axial rows. When the reduced fragments of input material are small enough, they pass through the grate openings 114*a* and leave the machine. The discharge grate 114 has a high wear rate and, as a sacrificial component, has to be replaced frequently. The discharge grate 114, however, does not wear as fast as the hammers 112, which must be replaced more frequently.

Features of conventional or known discharge grates 114 will be described in more detail in conjunction with FIGS. 1C through 1K. As shown in FIG. 1C, the bottom and side portions of this example discharge grate 114 (e.g., extending approximately 80° to 250° around the circle defined by rotary motion of the shredder head 110) are made from a plurality of separate discharge grate components 130 aligned around a portion of the circumference of the circle. Five individual discharge grate components 130 are shown in the example of FIG. 1C. The discharge grate components 130 include a structure that engages with a corresponding structure provided on a mounting frame 132, e.g., associated with the shredder housing, drum, or other reduction machine, to mount the discharge grate components on the frame 132. The discharge grate components 130 are individually abutted against the mounting frame 132 and slid (or otherwise moved) along the frame rails to the desired location in the overall discharge grate structure 114 (e.g., using a crane or other lifting equipment).

FIGS. 1D through 1K show various views of an individual discharge grate component 130, including a bottom perspective view (FIG. 1D), a top perspective view (FIG. 1E), a top view (FIG. 1F), an end view (FIG. 1G), a front view (FIG. 1H), and cross sectional views (FIG. 1I-1K) taken along line B-B in FIG. 1H. As shown in these figures, this discharge grate component 130 includes two longitudinally oriented grate elements 136*a* and 136*b* with a plurality of transverse grate elements 134 extending between the longitudinal grate elements 136*a* and 136*b*. The grate discharge openings 114*a* are defined between the longitudinal grate elements 136*a* and 136*b* and the transverse grate elements 134 to provide the sieve or webbing structure to the interior working surface 134S of the grate component 130 (see FIG. 1E). The outer sides of longitudinal grate elements 136*a* and 136*b* include portions of transverse grate elements 134 that will be used to form portions of grate discharge openings 114*a* with adjacent discharge grate components 130 when the plurality of grate discharge components 130 are mounted around the mounting frame 132.

As shown in these figures, longitudinal support beams 138*a*, 138*b* are provided in this grate component structure 130 as integral extensions of the longitudinal grate elements 136*a*, 136*b*, respectively, that form edges of the grate discharge openings 114*a*. The longitudinal support beams 138*a*, 138*b* in this illustrated example have an arched structure that extends outward (away from working surface 134S) and has greater height at the center of the longitudinal direction as compared to its height at the edges (near ends 140). This feature provides support against deformation and bending at the longitudinal center area (and the frames 132 at the longitudinal ends 140 of the grate component 130 help provide additional support against deformation and bending at locations near the ends 140). Because of the presence of longitudinal support beams 138*a*, 138*b*, as perhaps best shown in FIG. 1D, the longitudinal grate elements 136*a*, 136*b* extend outward (and away from working surface 134S) beyond the outer surfaces 134*a* of the transverse grate elements 134 in this structure 130. At least one of the longitudinal support beams (138*a*, in this illustrated example) may include one or more handle elements 142 to better enable lifting and handling of the grate component 130, e.g., by a crane. Longitudinal support beam shapes other than arched are possible, such as rectangular or trapezoidal shapes.

As shown in FIG. 1I, the discharge opening 114*a* is oriented at an angle $\alpha$ with respect to a direction normal N to the interior working surface 134S of the webbing structure defined by the longitudinal grate elements 136*a* and 136*b* and the transverse grate elements 134. In conventional discharge grate components 130, this angle $\alpha$ is typically within a range of about 0° to 30°. The discharge angle helps better accept the reduced material within discharge opening 114*a* as the material is moving under the rotary force of the rotating hammer structure. Notably, however, for discharge grate components 130 located more on the side areas of the grate circle (e.g., area S shown in FIG. 1C), the extended longitudinal support beams 138*a*, 138*b* can provide a relatively long shelf on which discharged materials can get hung up during operation of the reducing equipment. This hang-up problem is further exacerbated by the solid construction of the support beams 138*a*, 138*b*.

The longitudinal support beams 138*a*, 138*b* oppose the direct force of the hammer 112 impacts and incorporate a substantial support structure to counter these impact loads. The support beams 138*a*, 138*b* constitute a significant portion of the mass of the grate component 130. As illustrated in FIG. 1J, however, because of the desired discharge angle $\alpha$ and the fact that the longitudinal support beams 138*a*, 138*b* are integrally formed extensions of the longitudinal grate elements 136*a*, 136*b*, the direction of greatest grate strength of the longitudinal support beams 138*a*, 138*b* (shown by arrows 144 in FIG. 1J) is angled from the direction of impact force from the hammers (shown by arrows 146 in FIG. 1J, e.g., in a direction normal to the interior working surface 134S of the grate component structure 130). If these directions 144, 146 get further away from alignment (i.e., if angle $\beta$ gets too large), this may lead to distortion or deflection of the grate component 130 and/or even to failure of the grate component 130. Distortion or deflection of the grate components 130 can lead to decreased performance due to decreased impact energy imparted by the hammers to the scrap and/or difficulty in removal of these components from the frame (e.g., increasing the need to trim or cut the grate to remove it from the mill). In an effort to combat distortion, deflection, or breakage, the longitudinal support beams 138*a*, 138*b* are made with the arched structure as described above, and at an angle of no more than about 30 degrees. This feature, however, further increases cost and weight of the overall grate component structure 130.

As noted above, this existing design of longitudinal support beams 138*a*, 138*b* on grate components 130 are structurally oriented to account for the direction of flow of the material exiting the mill through the discharge openings 114A. Because the longitudinal support beams 138*a*, 138*b* of existing grate components 130 are not aligned with the impact direction of the hammers, they are not optimally positioned to provide the best resistance to bending and deflection. This orientation can result in the beams 138*a*, 138*b* (and/or grate elements 136*a*, 136*b*) bending tangentially (e.g., in the circumferential direction) rather than outward from the drum. When bent or warped tangentially, the bent beam(s) may interfere with adjacent beams 138*a*, 138*b* and/or grate components 130 and/or with the mill housing or frame 132 so that on refurbishment, the grate components 130 become jammed and have to be cut out of the mill or can damage the mill housing. Bent beams 138*a*, 138*b* and/or bent grate elements 136*a*, 136*b* also can impede flow of material through discharge channels 114A and/or result in plugging the channels 114A. Also, beam support material located away from the impact surface 134S of the grate component 130 is bulky and inefficient, resulting in unnecessary throw-away weight/scrap material after service.

As is evident from the above description, grate components 130 are exposed to extremely harsh conditions of use. Thus, grate components 130 typically are constructed from hardened steel materials, such as low alloy steel or high manganese alloy content steel (such as Hadfield Manganese Steel, containing about 11 to 14% manganese, by weight). Such materials are known and used in the art. Even when such hardened materials are used, however, the surface 134S of the grate components 130 facing the hammers 112 wears significantly and the grate components 130 are replaced on a regular basis to maintain production rates. The balance of the grate components 130 (e.g., the outer surfaces and structures, including beam supports 138*a*, 138*b*) experience much less wear and serve as support structures that are subsequently scrapped when the interior working surface 134S becomes excessively worn. FIG. 1K generally illustrates portions of a typical grate component 130 that may be scrapped when the useful life of the grate component 130 has ended (e.g., the top portion of the grate component 130 shown in FIG. 1J will have been largely ablated and worn away after significant use). As is evident from FIG. 1K, significant portions of the beams 138*a*, 138*b* and grate elements 136*a*, 136*b*, 134 may be scrapped.

Accordingly, there is room in the art for improvements in the structure and construction of grates for reducing equipment.

SUMMARY OF THE INVENTION

This invention relates to discharge grate components, discharge grates including such discharge grate components, and shredding or other reducing machines including such discharge grates and discharge grate components.

In accordance with one aspect of the invention, a discharge grate component includes a single longitudinal support beam and two longitudinal grate elements. The two longitudinal grate elements may be oriented with respect to a plurality of transverse grate elements (or otherwise form a portion of a sieve or webbing structure) to provide discharge openings through the grate component.

In another aspect of the invention, a discharge grate component includes one or more openings extending through the longitudinal support beam(s) of the grate component. These openings enable improved flow-through of the discharged material and reduced weight for easier handling, reduced manufacturing cost, and less throw-away material when worn out.

In another aspect of the invention, the longitudinal grate elements of a discharge grate component terminate short of the full extension of the support beam(s) for reduced weight and to enable a greater range of discharge angles.

In another aspect of the invention, a discharge grate component has a support beam that is oriented radially to better oppose and resist the loads applied by the hammers during use of the reducing machine.

In another aspect of the invention, a discharge grate component has more longitudinal grate elements than support beams.

Grate component structures in accordance with examples of this invention may be constructed such that the angular orientation of the longitudinal support beam is independent of angular orientation of the longitudinal grate elements provided in the grate components (the "angular orientations" may be measured with respect to a radial direction from the drive shaft of the hammer and/or with respect to a direction perpendicular to a working face of the grate component at the location). In some examples of this invention, the longitudinal support beam will extend outward (away from the working surface) in a direction parallel to or aligned with the radial direction from the drive shaft of the hammer and/or in a direction perpendicular to a working face of the grate component at the location of the longitudinal support beam.

Grate component structures in accordance with some examples of this invention will have a longitudinal support member that is separated from the structure and function of the longitudinal grate elements. In this manner, the longitudinal support member can resist bending and deflection of the overall grate component and the longitudinal grate elements can be configured and oriented to reduce wear at the interior impact face of the grate component and/or to provide optimal discharge opening angles and/or orientations.

In grate component structures in accordance with some examples of this invention, at least some of the transverse grate elements that define the grate discharge openings will extend outward beyond an outer surface of the longitudinal grate elements.

Grate component structures according to some examples of the invention may be made so that the outer surfaces of at least some of the transverse grate elements extend outward (away from the working surface), beyond an outer surface of the longitudinal grate elements, and form a base from which the longitudinal support beam extends and/or is formed. The longitudinal support beam may be formed as an integral, one-piece structure extending from the outer surfaces of at least some of the transverse grate elements.

Grate structures in accordance with examples of this invention may include multiple grate components of the types described above. In such grate structures, the angular spacing or separation between adjacent longitudinal support beams of adjacent discharge grate components (as measured from the drive shaft axis of the rotor) may be about X°/N, wherein X is the number of degrees from: (a) an outer edge of one grate component in the grate structure (e.g., the grate component nearest the anvil) to (b) an opposite outer edge of another grate component (e.g., the grate component at the opposite end of the grate structure); and N is the number of individual grate components located between these outer edges (e.g., a total number of grate components in the grate structure). As still additional examples, grate structures in accordance with examples of this invention will have N longitudinal support beams located within the range of X° (i.e., one longitudinal support beam per grate component).

Grate structures in accordance with examples of this invention may include multiple grate components sized and oriented such that the angular spacing or separation between adjacent longitudinal support beams of adjacent discharge grate components (as measured from the drive shaft axis of the rotor) are greater than or equal to 8°. In one preferred construction, the angular separation between adjacent longitudinal support beams 238 of adjacent discharge grate components 230 are within a range of 8° to 36°, and in another preferred construction the angular separation is within a range from 8° to 30°.

Additional aspects of this invention relate to providing a reduction mill grate assembly that may be installed in existing reduction mills and retrofitted onto existing reduction mill equipment components and provide a support structure (and an individual grate component structure) with a lower mass. A lower mass for the grate assembly will correspond to a lower cost component that is more easily handled and that results in less scrap material when the grate components are replaced. The grate components will provide adequate, if not improved, support; resistance to bending, deflection, and/or warping; and/or material discharge.

Other aspects, advantages, and features of the invention will be described in more detail below and will be recognizable from the following detailed description of example structures in accordance with this invention.

BRIEF DESCRIPTION OF THE DRAWINGS

The present invention is illustrated by way of example and not limited in the accompanying figures, in which like reference numerals indicate the same or similar elements throughout, and in which.

The reader is advised that the various parts shown in these drawings are not necessarily drawn to scale.

DETAILED DESCRIPTION

The following description and the accompanying figures disclose example features of reducing equipment structures, discharge grates, and individual components of those grates in accordance with the present invention.

The terms "longitudinal," "transverse," "axial," "radial," and the like are used in this specification to describe various angular orientations, directions, and/or features of structures according to the invention. Structures in accordance with this invention may be used in conjunction with a shredder head that rotates around a central axis of rotation. The terms "longitudinal" and "axial" as used herein refer to a direction that generally parallels the axis of rotation of the head of the shredding or reducing machine. An element may be straight or curved and still extend in the "longitudinal" or "axial" directions. The term "transverse" as used herein refers to a direction that generally parallels the circular or circumferential direction defined by rotation of the head. An element may be straight or curved around the circumferential direction and still extend the "transverse" direction. A "transverse" element need not be oriented at 90° from a "longitudinal" or "axial" element at any or all locations, although it may be oriented at a 90° angle at least at some portions. The term "radial" as used herein refers to a direction generally extending 90° from the axis of rotation of the head.

Figure 1A:
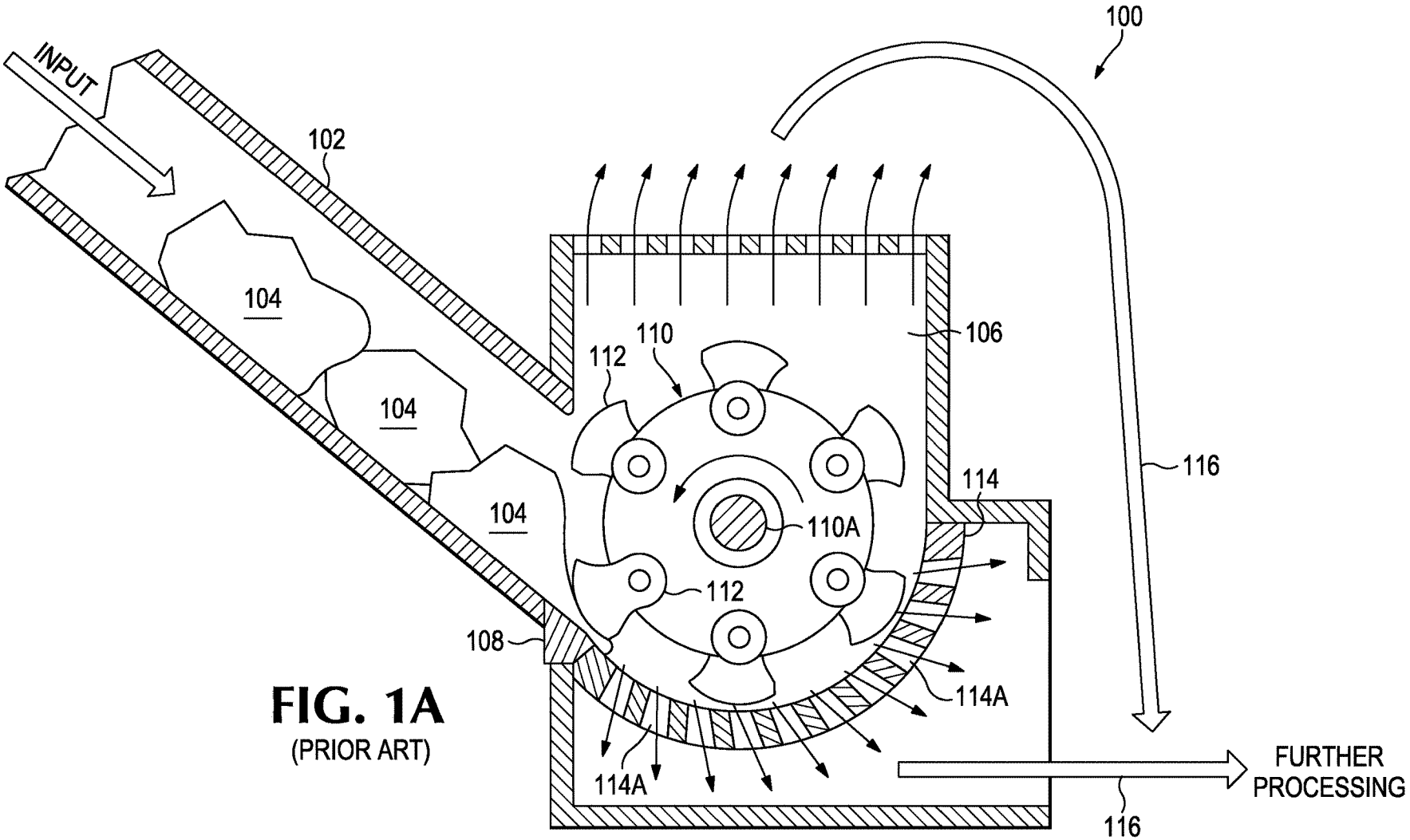
FIG. 1A (PRIOR ART)
FIGS. 1A through 1K illustrate features of conventional shredding systems and discharge grate components associated with them.
Figure 1B:
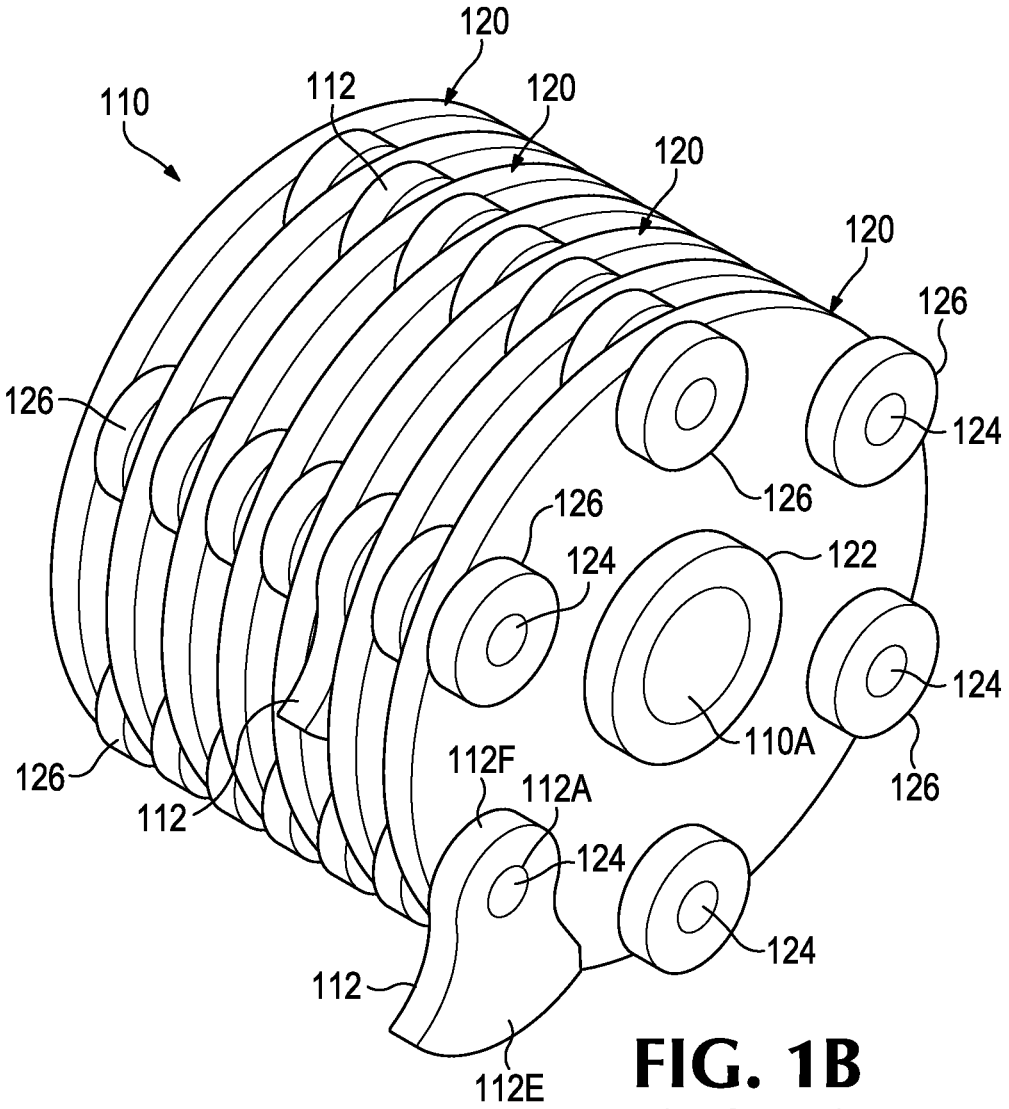
FIG. 1B (PRIOR ART)
Figure 1C:
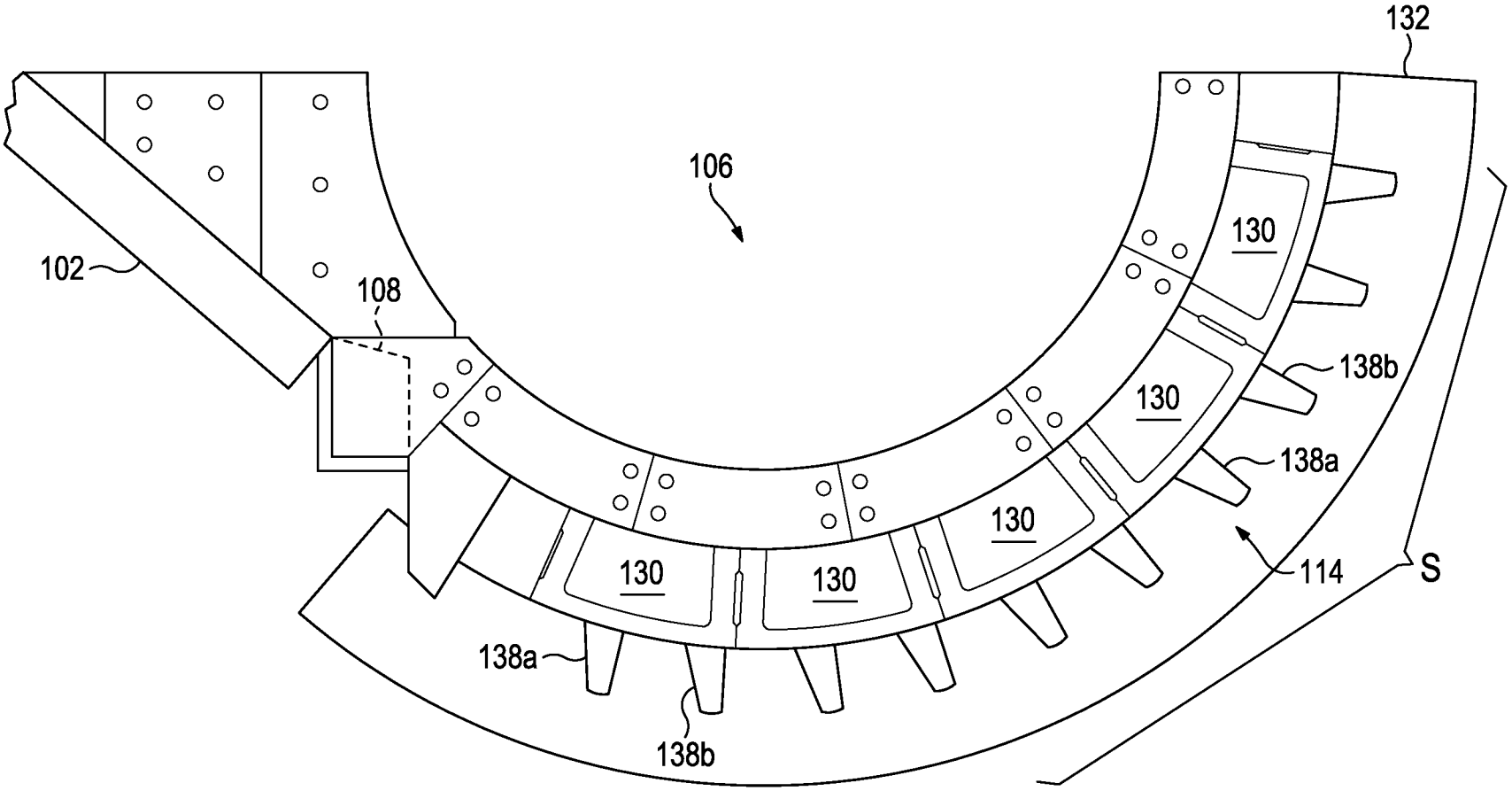
FIG. 1C (PRIOR ART)
Figure 1D:
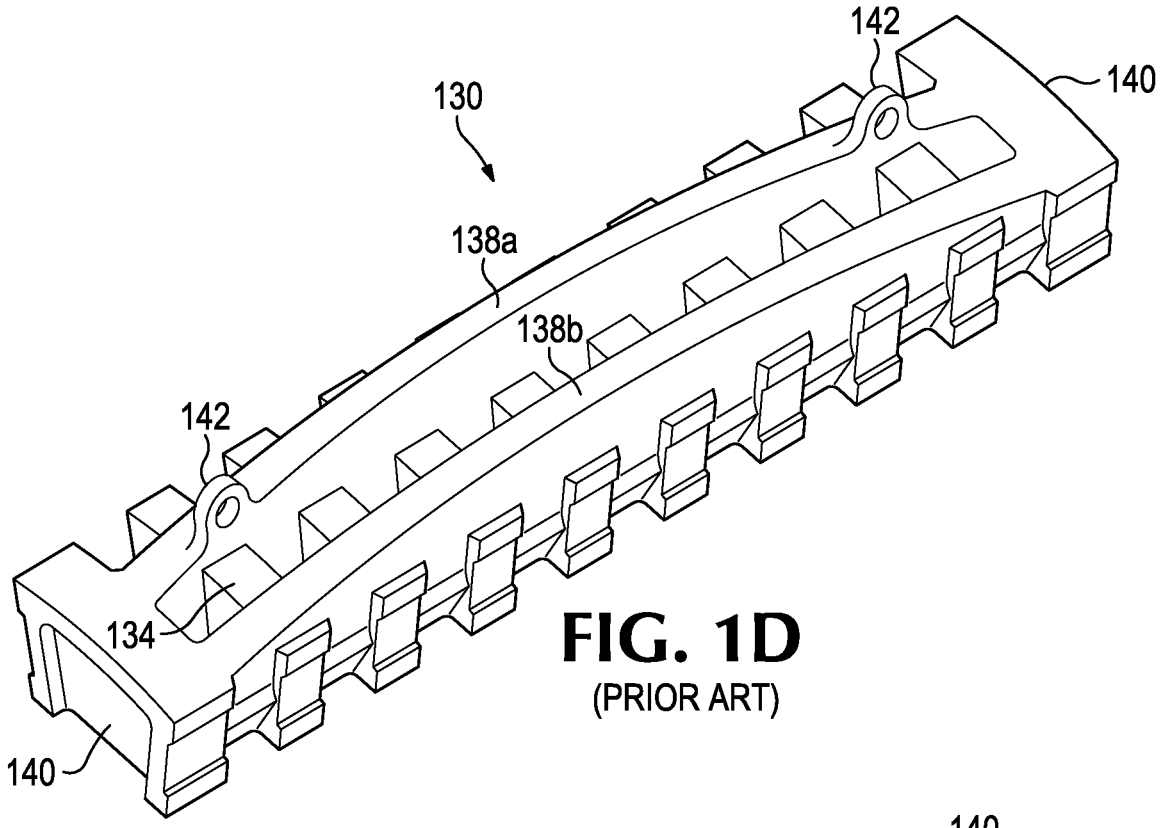
FIG. 1D (PRIOR ART)
Figure 1E:
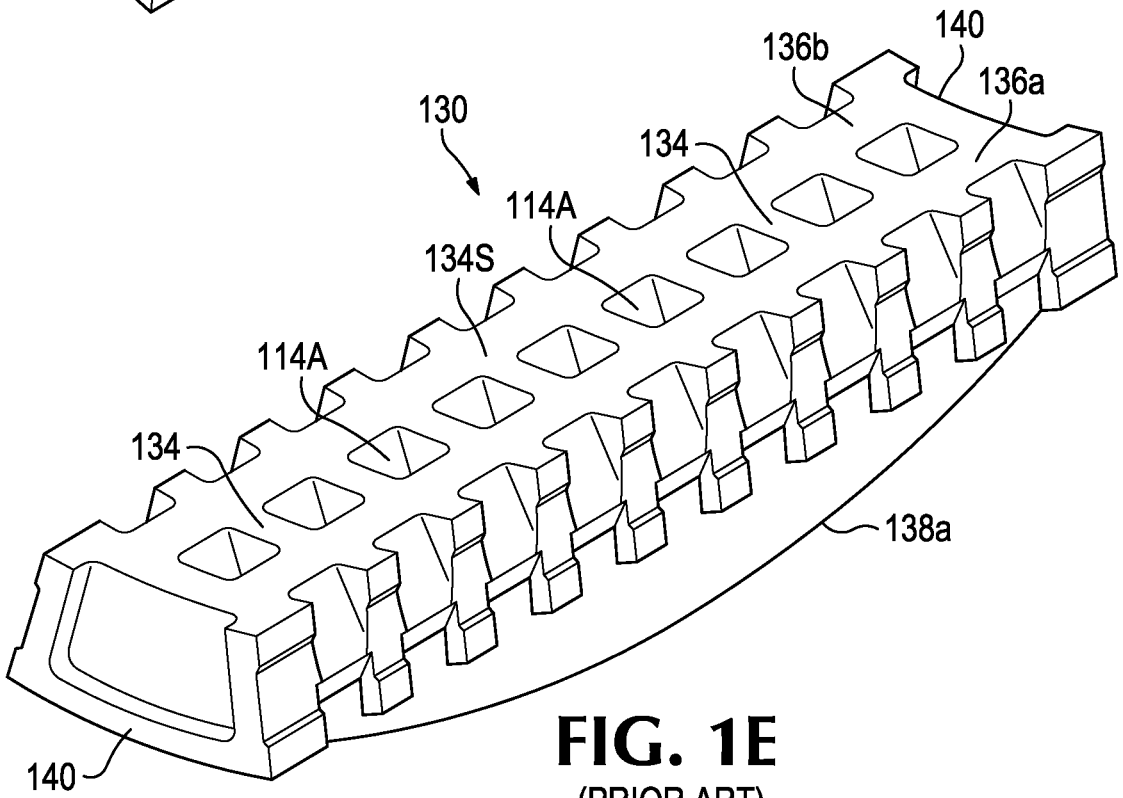
FIG. 1E (PRIOR ART)
Figure 1F:
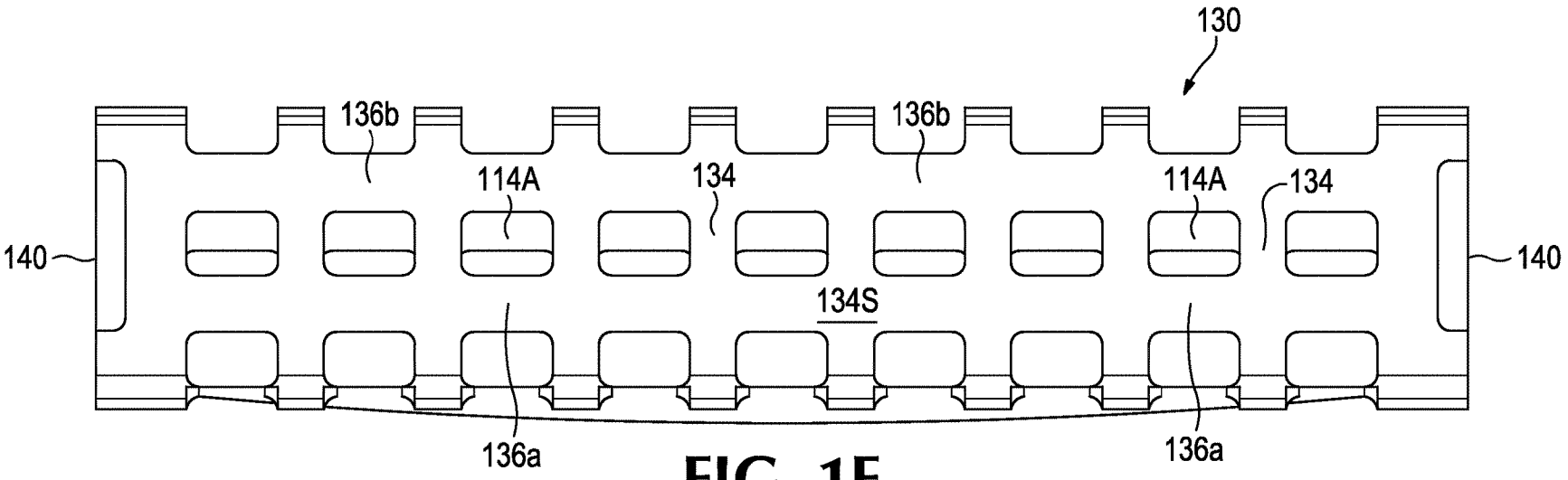
FIG. 1F (PRIOR ART)
Figure 1G:
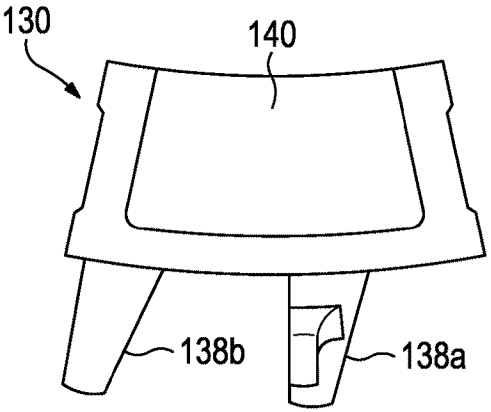
FIG. 1G (PRIOR ART)
Figure 1H:
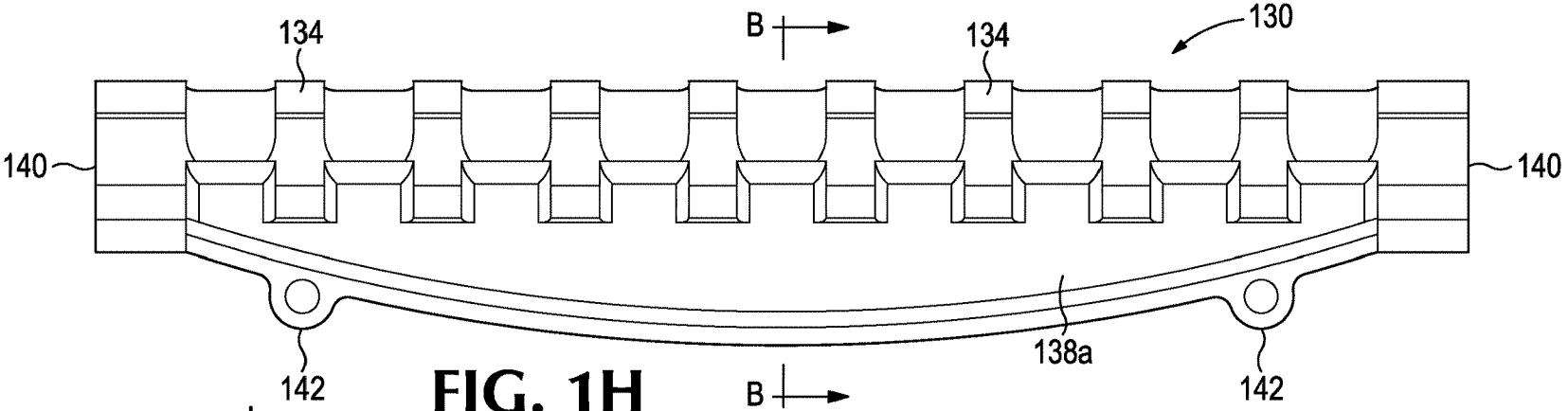
FIG. 1H (PRIOR ART)
Figure 1K:
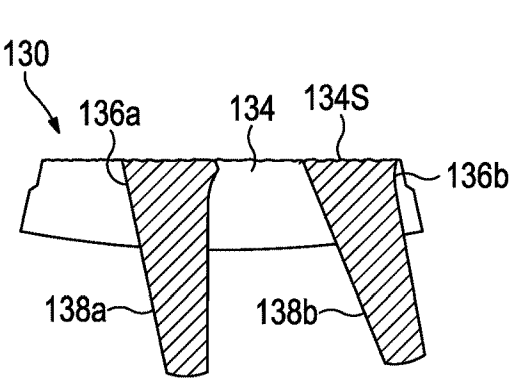
FIG. 1K (PRIOR ART)
Figure 1J:
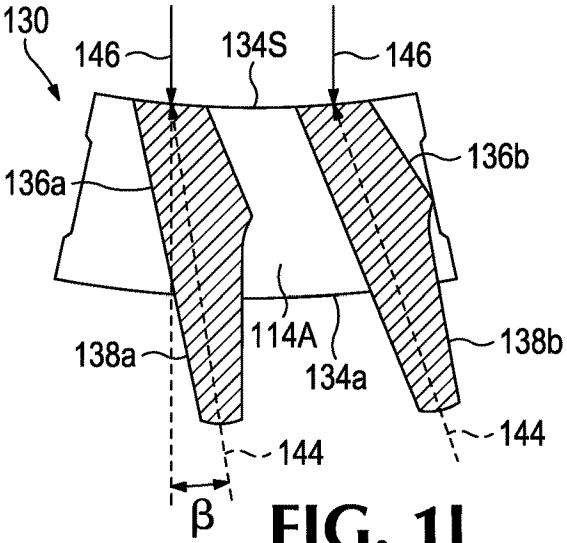
FIG. 1J (PRIOR ART)
Figure 1I:
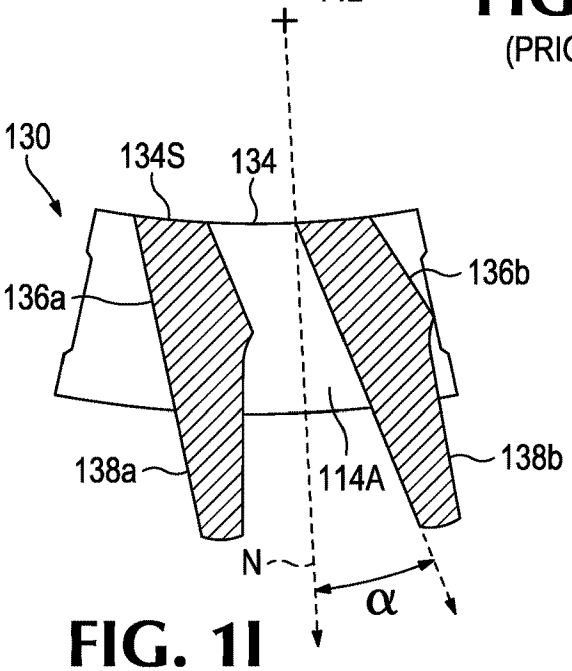
FIG. 1I (PRIOR ART)
Figure 2A:
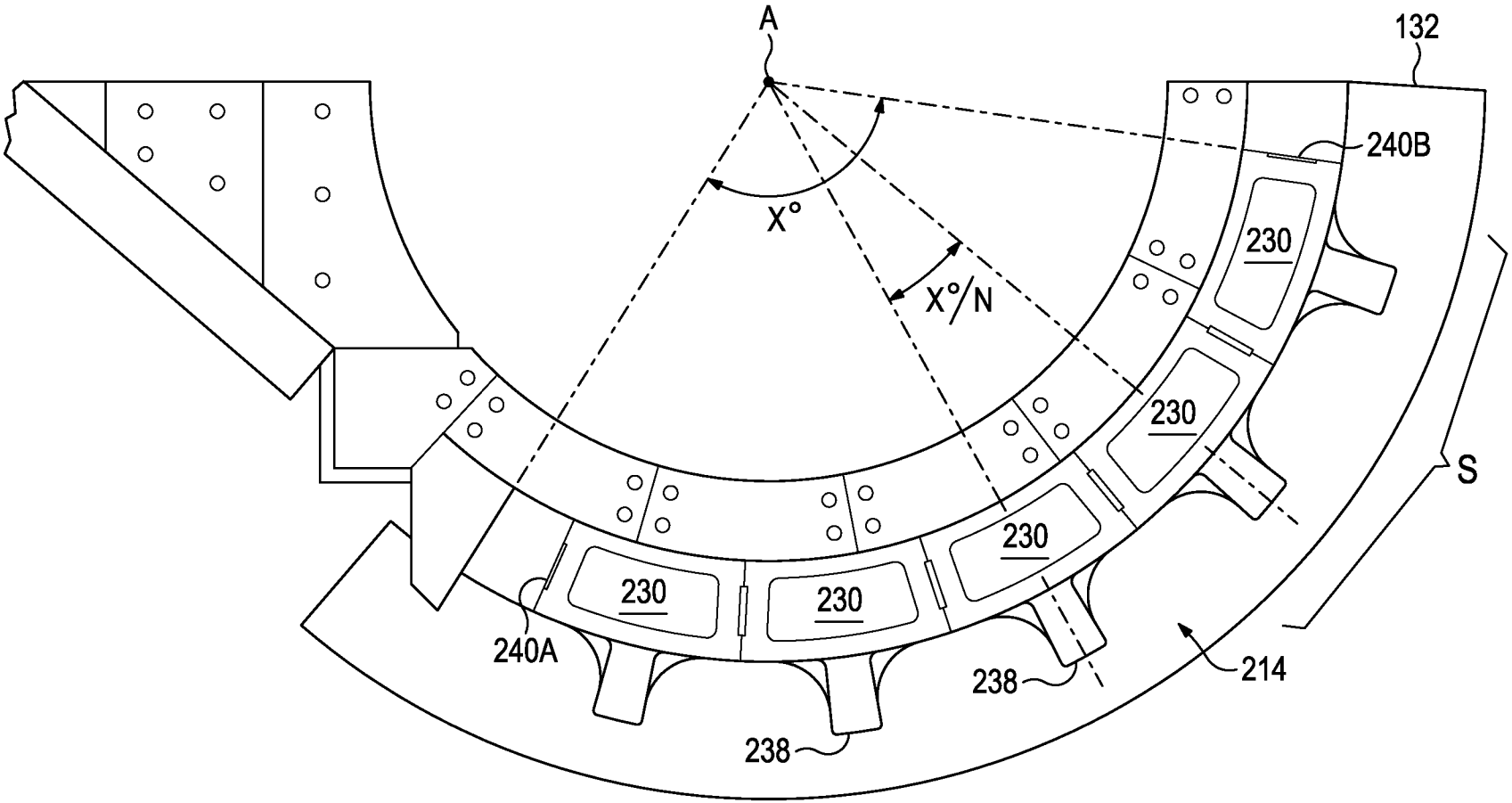
FIGS. 2A through 2I illustrate features of reduction equipment and discharge grate components in accordance with examples of this invention.
Figure 2B:
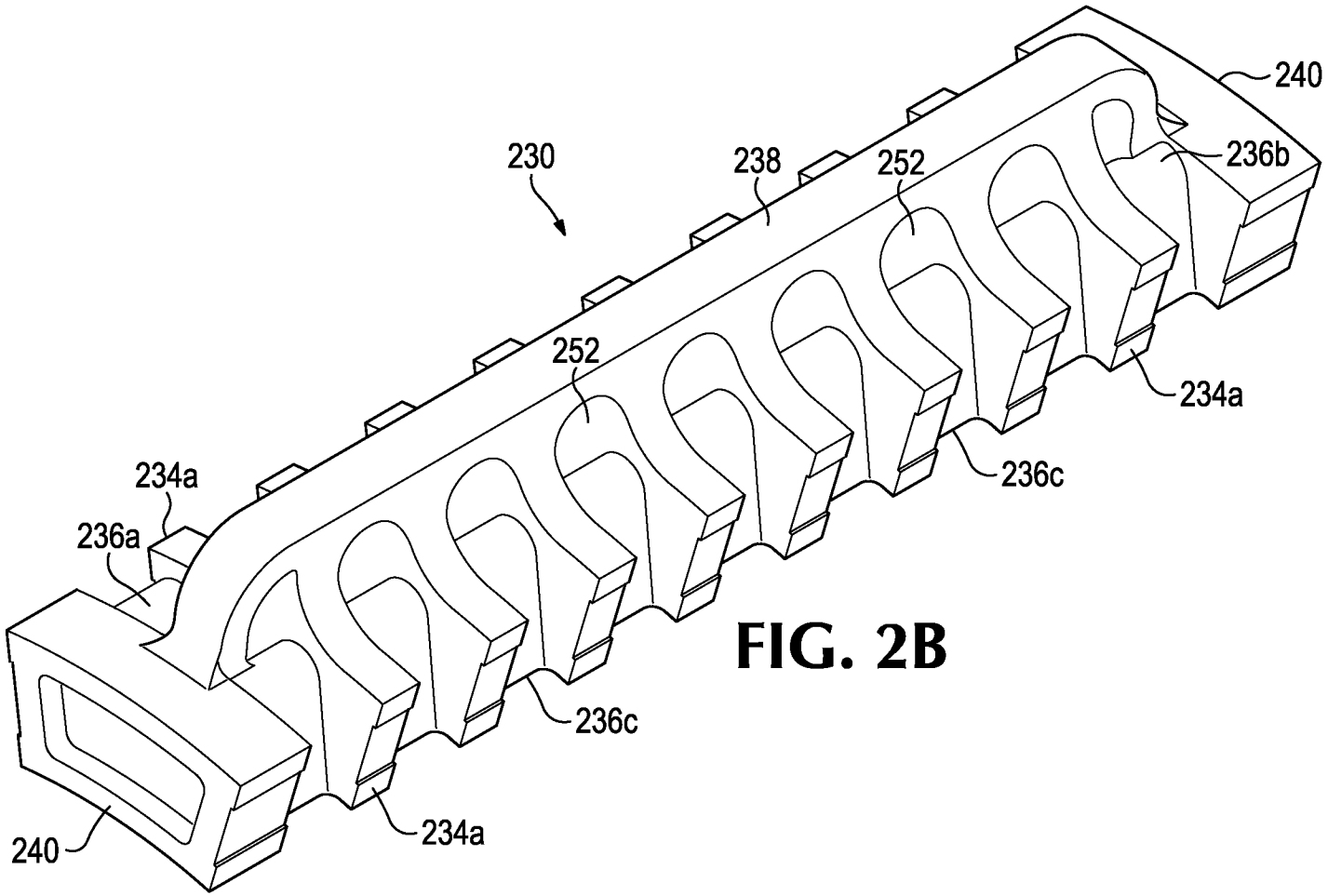
Figure 2C:
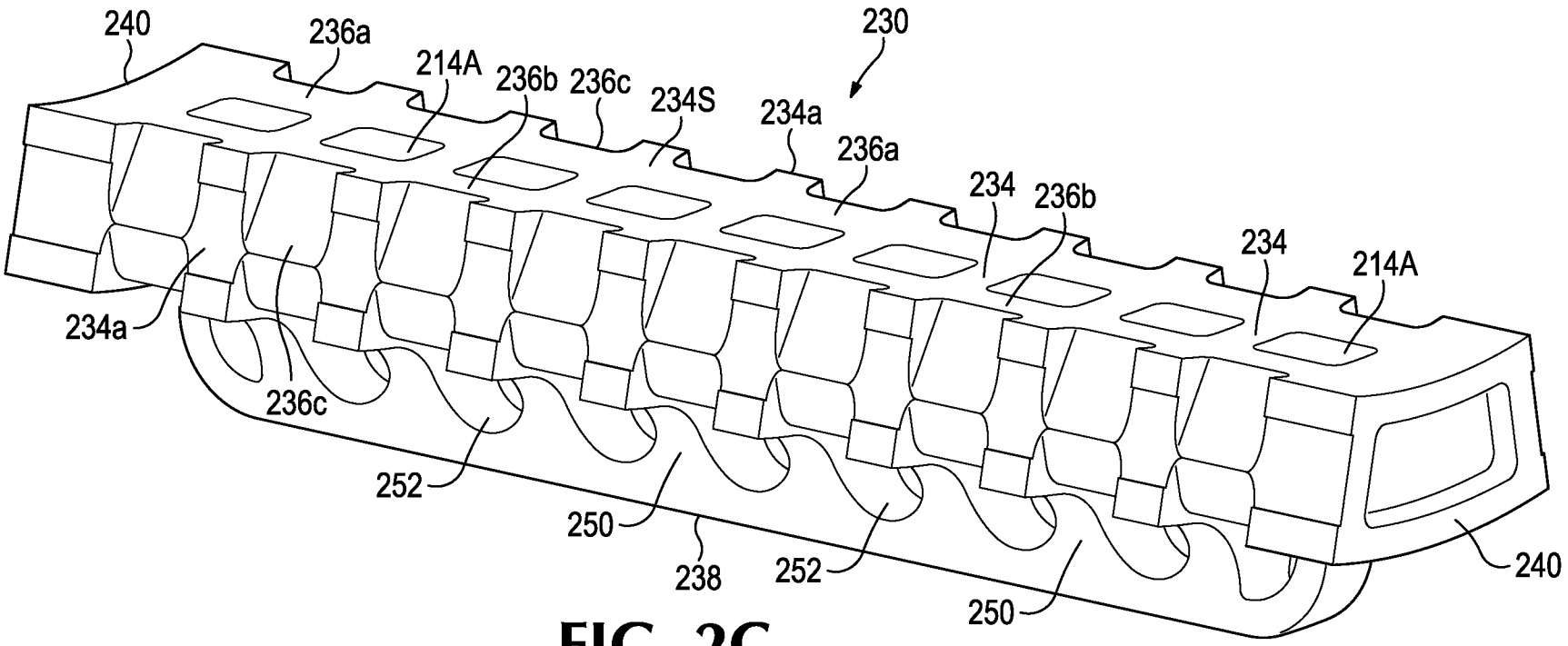
Figure 2D:
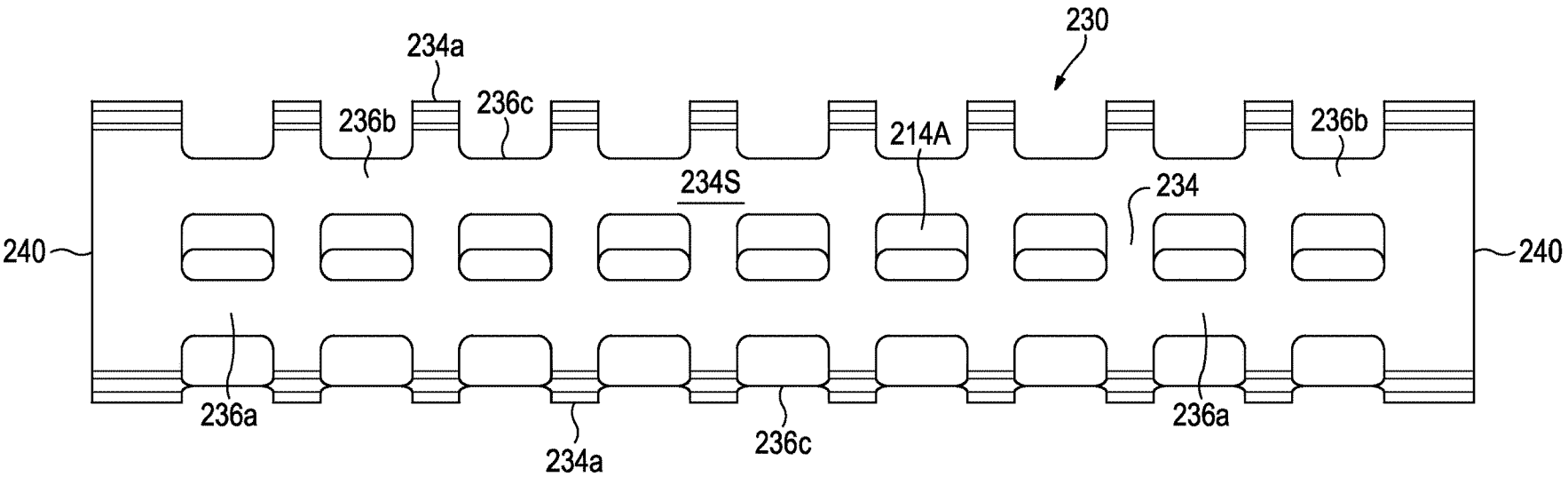
Figure 2E:
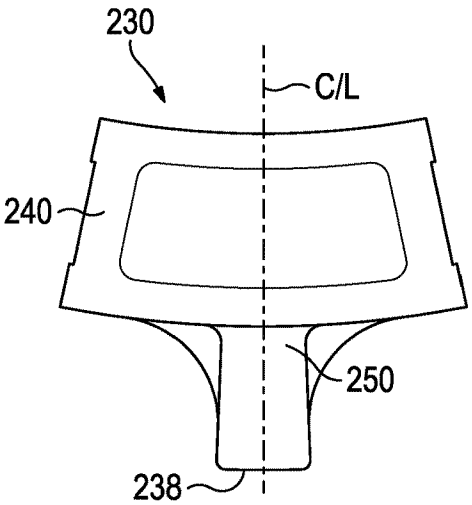
Figure 2F:
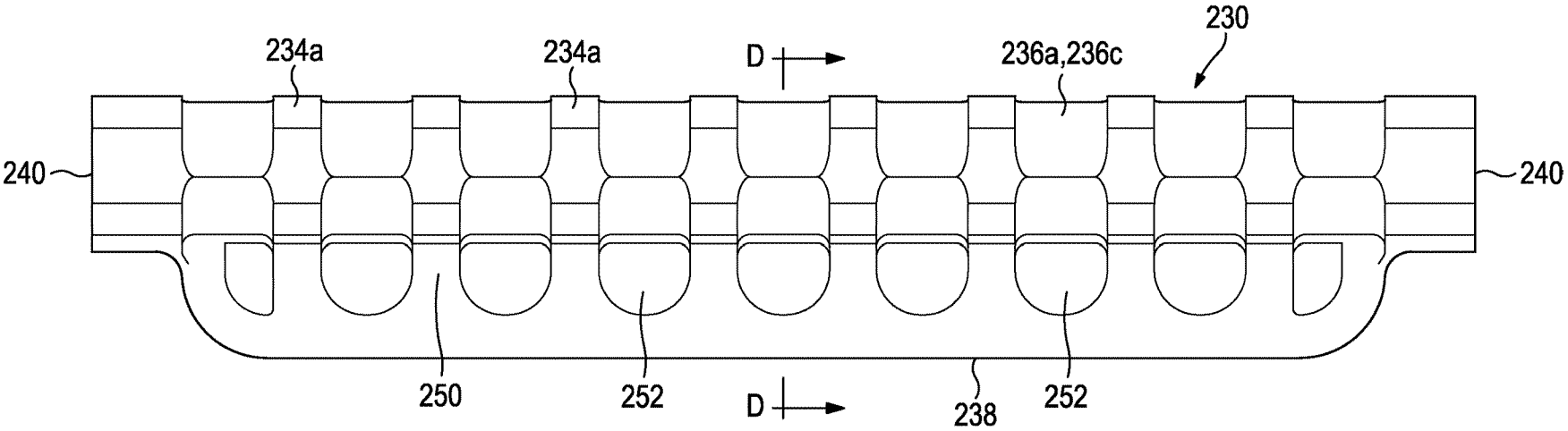
Figure 2H:
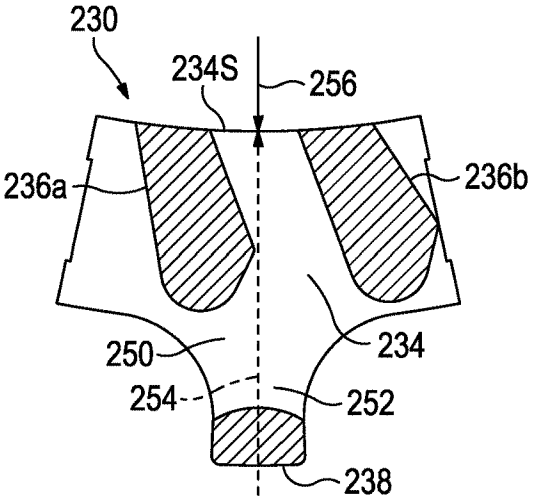
Figure 2G:
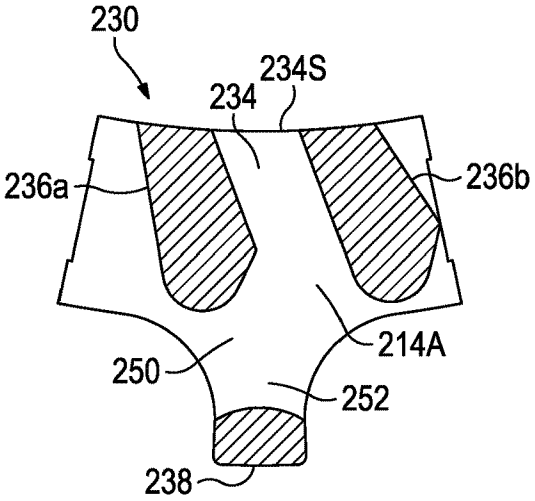
Figure 2I:
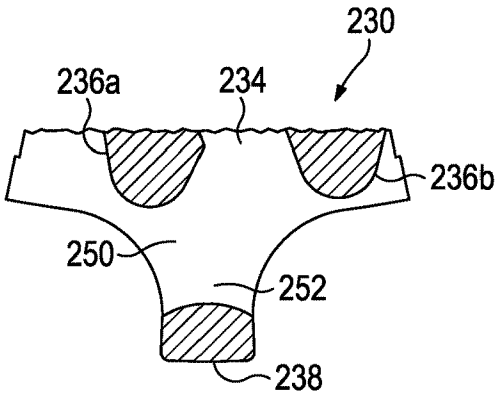

FIGS. 2A through 2I illustrate various features of discharge grates and individual discharge grate components that form the grates in accordance with examples of this invention. FIG. 2A is a view similar to FIG. 1C showing a discharge grate 214 engaged with a frame member 132 of reducing equipment, and this frame member 132 may have a structure the same as or similar to the frame member 132 shown in FIG. 1C. FIG. 28 provides a bottom perspective view of an individual grate component 230 in accordance with one example of this invention, and FIG. 2C provides a top perspective view of this grate component 230. FIG. 2D provides a top view of the grate component 230; FIG. 2E provides an end or side view of the grate component 230; FIG. 2F provides a front view of the grate component 230; and FIG. 2G provides a sectional view of the grate component 230 taken along line D-D in FIG. 2F. FIGS. 2H and 2I are provided to illustrate various additional features and properties of the individual grate components 230 shown in FIGS. 2A through 2G.

As shown in FIG. 2A, the bottom and side portions of this example discharge grate 214 (e.g., extending approximately 100° to 140° around the circle defined by rotational motion of a shredder head) is made from a plurality of separate discharge grate components 230 aligned around a portion of the circumference of the circle. Five individual discharge grate components 230 are shown in the example of FIG. 2A, although more or less may be used without departing from this invention. The discharge grate 214 also may extend around a greater or lesser portion of the circle. The discharge grate components 230 may include a structure that engages with a corresponding structure provided on a mounting frame 132, e.g., associated with the shredder or other reduction equipment, to enable the discharge grate components 230 to be mounted on the frame 132. If desired, the individual discharge grate components 230 according to the invention may include structures that enable them to be engaged with existing reduction equipment (e.g., existing frames 132 provided on conventional shredding or other reduction mill equipment) so that the discharge grate components 230 of the invention might be used to replace conventional discharge grate components (e.g., 130). The discharge grate components 230 are individually engaged with the mounting frame 132 and slid or otherwise moved along the frame 132 to the desired location in the overall discharge grate structure 214 (e.g., using a crane or other lifting equipment).

FIGS. 2B through 2G show various views of an individual discharge grate component 230. As shown in these figures, this discharge grate component 230 includes two longitudinally oriented grate elements 236*a* and 236*b* with a plurality of transverse grate elements 234 extending between the longitudinal grate elements 236*a* and 236*b*. Grate discharge openings 214A are defined between the longitudinal grate elements 236*a* and 236*b* and the transverse grate elements 234 to provide the sieve or webbing structure to the interior working surface 234S of the grate component 230 (see FIGS. 2C, 2D, and 2G). While generally rectangular shaped discharge openings 214A are shown at the working surface 234S in this illustrated example grate structure 214, other opening sizes and shapes also may be used without departing from this invention, including different discharge opening sizes and shapes within an individual grate component 230 and/or within a single grate 214.

Portions of additional transverse grate elements 234*a* (called "exterior transverse grate elements" herein) extend from the outer sides 236*c* of longitudinal grate elements 236*a* and 236*b*. These portions of exterior transverse grate elements 234*a* cooperate with similar exterior transverse grate elements 234*a* of adjacent discharge grate components 230 to form grate discharge openings 214A in areas between adjacent discharge grate components 230 when the plurality of grate discharge components 230 are mounted on the mounting frame 132. Although it is not a requirement, the exterior transverse grate elements 234*a* of this example structure are continuous with (and align with) the transverse grate elements 234 provided between the longitudinal grate elements 236*a*, 236*b*.

In this example grate component structure 230, at least some of the transverse grate elements 234 extend outward (away from working surface 2348) to a location beyond the outer surfaces of the longitudinal grate elements 236*a* and 236*b*. Note, for example, FIG. 2B. At least some of the outer surfaces of the transverse grate elements 234 include support extensions 250 that extend beyond the outer surfaces of longitudinal grate elements 236*a* and 236*b*, and these support extensions 250 form a base for supporting longitudinal support beam 238. The longitudinal support beam 238 may be supported at its ends by one or more of the ends 240 of the grate component 230, one or both of the longitudinal grate elements 236*a*, 236*b*, and/or the last transverse grate element 234 at the respective ends. In the illustrated example structure 230, all of the transverse grate elements 234 extend beyond the outer surfaces of longitudinal grate elements 236*a*, 236*b*. As a result, the longitudinal grate elements 236*a*, 236*b* can extend outward in a direction away from the working surface 234S substantially less than in the prior art, resulting in less weight and the ability for these grate elements 236*a*, 236*b* to be oriented at a greater range of angles.

In this illustrated example structure 230, the longitudinal support beam 238 is connected along its longitudinal length to each transverse grate element 234 by support extensions 250 extending outward from the transverse grate elements 234. This is not a requirement.

The longitudinal support beam 238 of this illustrated example includes additional advantageous features. As described above in conjunction with the grate component 130 structure of FIGS. 1C-1K, the longitudinal support beams 138*a*, 138*b* of that structure 130 were solid, components (arched or not arched) extending continuously outward from the longitudinal grate elements 136*a*, 136*b*. In contrast, the single longitudinal support beam 238 of this example of the invention includes openings 252 defined through it between adjacent transverse grate elements 234. These openings 252 not only lighten the weight of the grate component 230, they provide ample room for discharge of the shredded material through the discharge openings 214A. These openings 252 also provide room for discharged shredded material to fall through the longitudinal support beam 238 so that this longitudinal support beam 238 is less likely to act as a shelf on which discharged shredded material hangs up, even at the upper side area S of the overall discharge grate 214 (see FIG. 2A). The openings 252 also provide locations at which a crane or other lifting equipment can engage the grate component 230, e.g., for installation to the frame 132, for removal, for transport and/or other handling, etc. Other lift supports also could be provided on the grate component structure 230 (including on the beam 238), if desired. The provision of openings in the support beam is beneficial for improving the flow of the discharge material out of the reducing chamber of the machine and reducing weight of the discharge grate component even in grate components provided with two support beams and even when the support beams are formed as extensions of the longitudinal grate elements.

Notably, this example grate component structure 230 in accordance with the invention includes a single longitudinal support beam 238 (as opposed to the two beams 138*a* and 138*b* shown in the example construction of FIGS. 1C-1K). This single longitudinal support beam 238 provides sufficient support for a grate component structure 230 that includes two longitudinal grate elements 236*a*, 236*b*. The elimination of one longitudinal support beam in the grate component structure 230 according to this example of the invention (as compared to the structure of FIGS. 1C-1K) provides significant weight, raw material, and cost savings. It also results in less scrap material when the grate components 230 are worn and taken out of service, as will be described in more detail below. The use of a single longitudinal support beam 238 also halves the number of longitudinal support beams in the overall grate structure 214 (as compared to the example construction of FIGS. 1C-1K), which also provides a more open arrangement to allow better release of shredded material through the grate structure 214 (e.g., fewer extending longitudinal support beams and less beam surface area to interfere with discharged material flow, larger gaps between longitudinal support beams 238, etc.). The discharged material is more likely to get hung up in the more closely located longitudinal beam components 138*a*, 138*b* of the example structure of FIGS. 1C-1K as compared to the more spaced apart longitudinal beam components 238 of FIGS. 2A-2I.

In some examples of this invention, the grate components 230 in an overall grate 214 may all have the same structure, including the same discharge angles. This is not a requirement. Because the longitudinal support beams 238 of grate component structures 230 in accordance with this example of the invention do not extend continuously from the longitudinal grate elements 236*a*, 236*b*, these grate components 230 may be constructed such that the angular orientation of longitudinal support beam 238 is independent of the angular orientation of longitudinal grate elements 236*a*, 236*b* (the "angular orientations" may be measured with respect to a radial direction from the drive shaft of the hammer and/or with respect to a direction perpendicular to the working face 234S of the grate component 230). Therefore, the grate component structures 230 around a single grate structure 214 may be designed to have different angular orientations for the longitudinal grate elements 236*a*, 236*b* (and thus different angular orientations for the discharge openings 214A), if desired. This feature can allow the angular orientations for the longitudinal grate elements 236*a*, 236*b* and/or the discharge openings 214A to be optimized for specific locations around the overall grate structure 214 (e.g., the angular orientation of the longitudinal grate elements 236*a*, 236*b* and/or discharge opening 214A of the grate component 230 nearest to the anvil 108 may be different from the angular orientations of the longitudinal grate elements 236*a*, 236*b* and/or discharge openings 214A of the grate components 230 located downstream in the hammer rotational direction). This can help optimize discharge of shredded material through the grate 214. As still other examples, if desired, two or more grate components in a grate structure may have a first structure (e.g., with one discharge angle) while other grate components in the same grate structure may have one or more different structures (e.g., different discharge angles). Discharge grates in accordance with some examples of this invention may include one or more individual grate components 230 in accordance with aspects of the present invention combined with one or more conventional grate components.

In some examples of this invention, the longitudinal support beam 238 will extend outward in a direction substantially parallel to or substantially aligned with the radial direction from the drive shaft of the hammer and/or in a direction substantially perpendicular to a working face 234S of the grate component 230 at the location of the longitudinal support beam 238 (prior to wear of the working face 234S). Note, for example FIG. 2H.

This orientation and/or arrangement of the longitudinal support beam 238 with respect to the working face 234S of the grate component 230 is advantageous for other reasons as well. For example, as shown in FIG. 2H, when arranged in this manner, the direction of greatest strength of the grate component 230 (extending straight through the longitudinal support beam 238, down the center of the longitudinal support beam 238, as shown by arrow 254 in FIG. 2H) is substantially aligned with (and optionally directly aligned with) the direction of impact force on the working surface 234S from rotation of the hammers (shown by arrow 256 in FIG. 2H) and/or a direction normal to the working surface 234S at that location. By at least substantially aligning the directions 254 and 256, deformation, deflection, bending, and/or the likelihood of breaking the grate component 230 can be reduced (or eliminated). Additionally or alternatively, this feature also allows the longitudinal support beam 238 to provide adequate support for use while still allowing a manufacturer to reduce the overall weight of the grate component 230 (e.g., by including the openings 252 in the longitudinal support beam structure 238). This orientation and arrangement of the longitudinal support beam 238 provides the support material at locations and orientations where it will be most effective to provide adequate support and stiffness, and it accomplishes these objectives using a reduced amount of material in the structure (and thus at a reduced weight), as compared to the conventional structures described above. Reduced grate deflection also allows more of the impact energy of the hammers to be transferred to the material being processed (rather than being expended on deflecting the grate component 230).

As shown in FIG. 2E, in this illustrated example, the longitudinal support beam 238 is arranged so that its centerline C/L extends substantially parallel to a centerline C/L of the two ends 240 of the grate component 230. While it is not a requirement, the longitudinal support beam 238, the ends 240, and/or the transverse grate elements 234 may be symmetric on opposite sides of a plane extending into and out of the page of FIG. 2E along the centerline C/L. Other arrangements, however, in which the centerline of the support beam 238 does not align with the centerline of the ends 240 and/or in which one or more of the various components are not symmetrically shaped in the manner described above are possible without departing from this invention.

As shown in FIG. 2A, grate structures 214 in accordance with examples of this invention may include multiple grate components 230, e.g., of the types described above in conjunction with FIGS. 2B-2G. In such grate structures 214, the angular separation or spacing between adjacent longitudinal support beams 238 of adjacent discharge grate components 230 (e.g., as measured from radial rays extending from the drive shaft axis of the rotor to corresponding locations on the outer surfaces of two adjacent longitudinal support beams 238) may be about X°/N, wherein X is the number of degrees from: (a) an outer edge 240A of one grate component 230 in the grate structure 214 (e.g., the grate component 230 nearest to the anvil and/or the first grate component 230 in the grate 214 with respect to a hammer swing direction) to (b) an opposite outer edge 240B of another grate component 230 (e.g., the grate component 230 at the opposite end of the grate structure 214 and/or the last grate component 230 in the grate 214 with respect to a hammer swing direction); and N is the number of individual grate components 230 located between these outer edges 240A, 240B (e.g., a total number of grate components 230 in the grate structure 214). In the example structure illustrated in FIG. 2A, for the entire grate structure 214 the angle X is about 120°, the number N is 5, and the separation angle of adjacent longitudinal support beams 238 is about 120°/5, or about 24°. While the angular orientation measurements can be made at any corresponding locations on two adjacent longitudinal support beams 238, in some examples of this invention, the radial rays from the drive shaft axis A of the rotor will extend to points on the centerline C/L of the longitudinal support beams 238. As also shown in this example, the number of longitudinal support beams may have a 1:1 relationship with the number of grate components 230 in the overall grate structure 214 (or within an X° range of the overall grate structure 214).

As other examples, grate structures 214 in accordance with this invention that include multiple grate components 230 may include multiple grate components 230 that are sized and oriented such that the angular separation between adjacent longitudinal support beams 238 of adjacent discharge grate components 230 (e.g., as measured from the drive shaft axis of the rotor) are greater than or equal to 8°. In one preferred embodiment, the angular separation between adjacent longitudinal support beams 238 of adjacent discharge grate components 230 are within a range of 8° to 36°, and in some examples, within a range from 8° to 30°.

As described above, some aspects of this invention relate to providing a reduction mill grate assembly 214 that may be installed in existing reduction mills and provide a support structure (and an individual grate component structure 230) with a lower mass. A lower mass for the grate assembly 214 will correspond to a lower cost grate component 230 that is more easily handled (e.g., for installation on frame 132) and that results in less scrap material when the grate components 230 are replaced. FIG. 2I illustrates portions of a grate component 230 in accordance with this example of the invention that may be scrapped when the useful life of the grate component 230 has ended (e.g., the top portion of the grate component 230 shown in FIG. 2H may have been largely ablated and worn away after significant use). As evident from a comparison of FIG. 2I with the similar view of FIG. 1K, aspects of this invention can result in a significant reduction of scrapped material (e.g., due to the presence of a single longitudinal support beam 238 and/or the presence of multiple openings 252 through this longitudinal support beam 238 as compared to the known grate component structure 130).

As a more concrete example of this potential weight and material savings, for a 74 inch (188 cm) shredder using four grate components 130, 230 to form a grate structure 114, 214 (made from the Hadfield Manganese Steel material described above), a grate component 230 having the structure of FIGS. 2A-2I will weigh about 265 lbs less than the corresponding grate component 130 of FIGS. 1C-1K (for a total weight savings of about 1060 lbs for the four grate components in the overall grate structure). This represents a weight savings of about 7%.

While described above as including various areas, regions, portions, or the like, those skilled in this art will recognize that grate components 230 in accordance with this invention may be made as one or more parts. In some more specific examples of this invention, the grate components 230 will constitute a single piece of material that is cast into the desired shape as described above and as illustrated in FIGS. 2A-2I. The grate components 230 may be made by methods as are conventionally known and used in this art (e.g., conventional casting and/or hardening methods). The grate components 230 also may be installed on reduction machines in manners that are conventionally known and used in this art.

The grate component 230 design and construction of at least some examples of the present invention at least somewhat separates the longitudinal grate elements 236*a*, 236*b* from the support (deflection and bend resistance) function of the longitudinal support beam 238 to better support the grate component 230 against the impact forces imparted by the hammers. The longitudinal support beam 238 resists deflection and bending, and the longitudinal grate elements 236*a*, 236*b* can be configured to resist wear at the impact face 234S and/or to provide the desired discharge angle for the shredded materials. Reduced deflection and bending results in less grate-to-grate interference and allows grate end supports 240 to function as designed (e.g., better allows the grate components 230 to slide on the frame rails or other structures, even after use). The single longitudinal support beam 238 alters the ratio of mass distribution between the impact face 234S and the support structure so that a larger percentage of the grate's mass is in the usable wear area where it will be most effective while providing the same stiffness. Lower installation weight, reduced throw-away weight, and equivalent performance to existing product significantly reduce operating costs for the capital machinery. Also, because the design of the beam 238 also centers the direction of greatest strength of the beam 238 so that it is substantially in line with the force of the hammer impacts (FIG. 2H), the tendency of the beam 238 to warp tangentially and/or bend transversely is reduced so maintenance (e.g., grate replacement) can be performed efficiently with minimal downtime of the equipment (e.g., less need to cut out grate components 230 that interfere with adjacent grate components 230 and/or that cannot be moved along the tracks of frame 132).

Because the longitudinal support beam 238 provides the primary structural support in countering bending and deflection of the grate component 230, the longitudinal grate elements 236*a*, 236*b* may be made somewhat smaller in cross section than the conventional longitudinal grate elements 136*a*, 136*b* that extend continuously into support beams 138*a*, 138*b*. Thus, if desired, the mass and amount of material used to make the longitudinal grate elements 136*a*, 136*b* may be reduced. This factor also can contribute to the reduction in mass of the grate components 230, the reduction in the amount of scrapped material at the end of the grate component's service life, and the ability to orient the longitudinal grate elements at a greater range of angles.

Figure 3A:
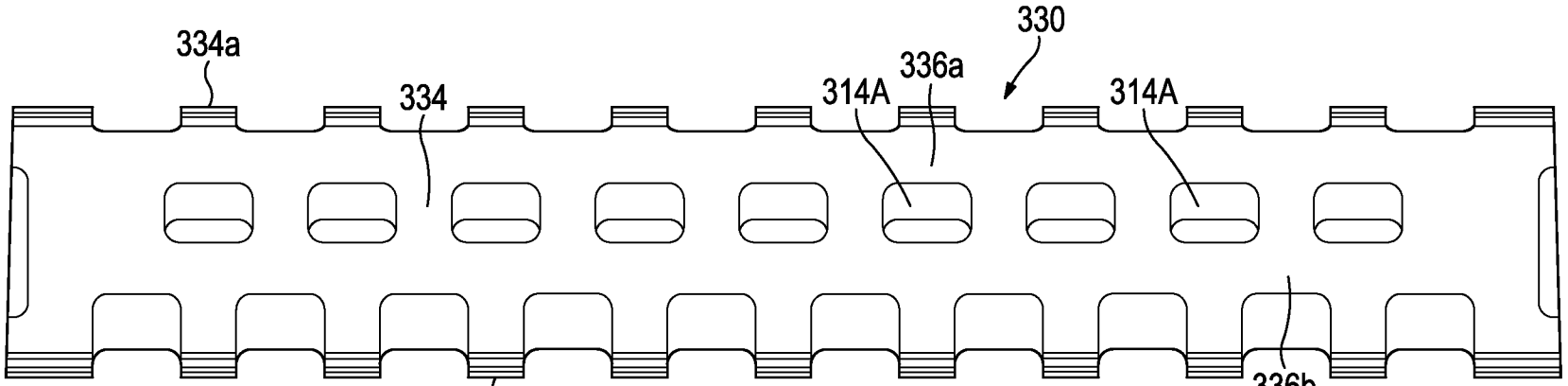
FIGS. 3A and 3B illustrate features of another example discharge grate component in accordance with this invention.
Figure 3B:
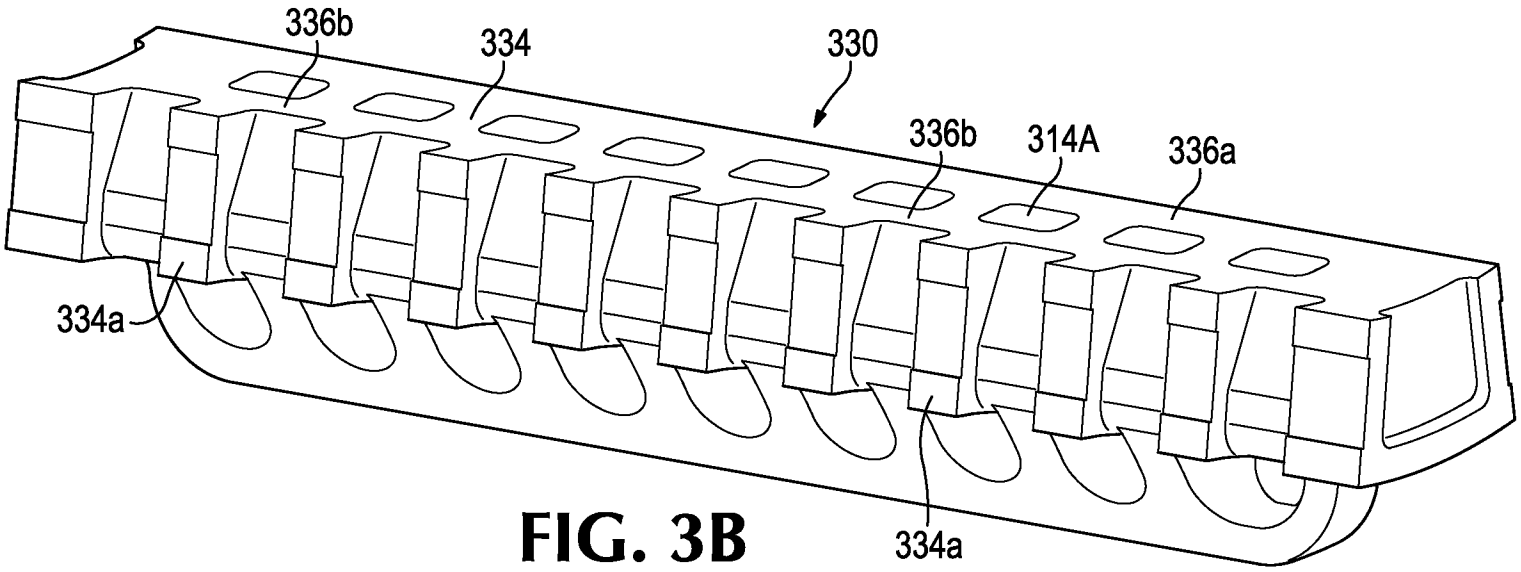

As noted above, in the example structure shown in FIGS. 2A-2I, the exterior transverse grate elements 234*a* are continuous with (and align with) the transverse grate elements 234 provided between the longitudinal grate elements 236*a*, 236*b*. This is not a requirement. For example, FIGS. 3A and 3B show an example grate component 330 in accordance with one example of this invention in which the transverse grate elements 334 (located between longitudinal grate elements 336*a*, 336*b*) are offset with respect to the exterior transverse grate elements 334*a*. In this manner, each longitudinal row of discharge openings 314A may be staggered or offset from adjacent longitudinal rows of discharge openings (e.g., the discharge openings formed between adjacent grate components 330 in an overall grate structure). This staggered arrangement of discharge openings provides more paths along which reduced scrap material can be pushed through the grate component 330.

When staggered, it is not required that each longitudinal row of discharge openings 314 be offset with respect to each adjacent row. Any desired pattern of staggered rows and unstaggered rows may be provided in an overall grate structure without departing from this invention. Also, it is not required that adjacent rows be staggered such that the centers of the discharge openings 314A of one longitudinal row of openings 314A are located halfway between the centers of the discharge openings 314A of the adjacent longitudinal rows of openings. Rather, any desired amount of longitudinal offset or stagger may be provided between adjacent rows.

Figures 4, 5:
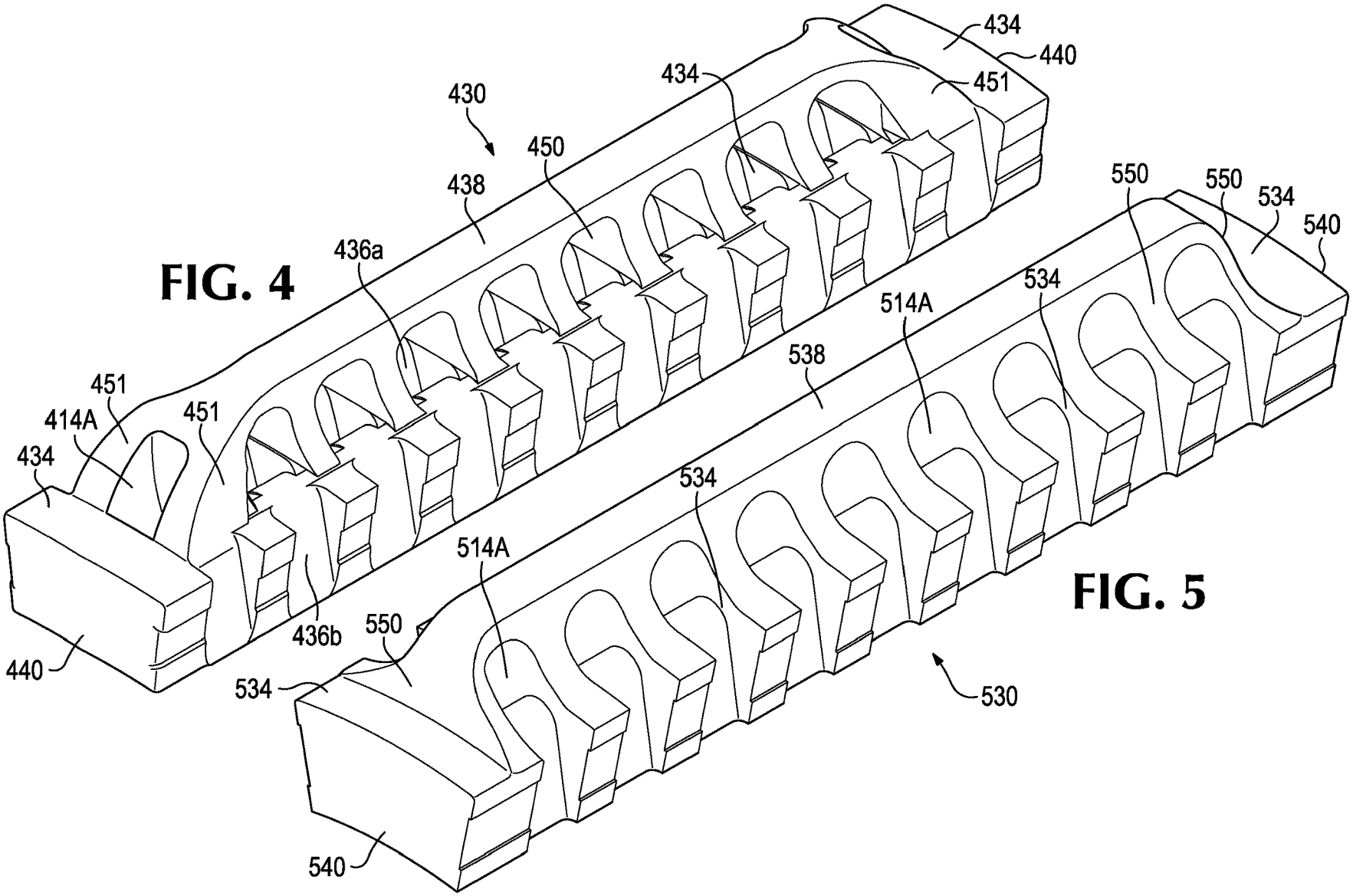
FIG. 4 illustrates features of another example discharge grate component in accordance with this invention.
FIG. 5 illustrates features of another example discharge grate component in accordance with this invention.

As noted above, in the example structure shown in FIGS. 2A-2I, the longitudinal support beam 238 is connected along its longitudinal length to each transverse grate element 234 by support extensions 250 extending outward from the transverse grate elements 234. This is not a requirement. For example, in one alternative embodiment shown in FIG. 4, a grate 430 similar to grate 230 is provided with a longitudinal support beam 438 that is connected along its longitudinal length to transverse grate elements 434 by support extensions 450 extending outward from the transverse grate elements 434. However, unlike grate 230 shown in FIGS. 2A-2I, the longitudinal support beam 438 is not connected to the last transverse grate element 434 on each end of the grate 440. Instead, longitudinal support beam 438 is connected to support extensions 451 adjacent ends 440 and extending outward from the longitudinal grate elements 436*a* and 436*b*. This allows the grate openings 414A adjacent ends 440 of grate 430 to be further opened up for material discharge. Other arrangements may include, for example, support extensions connecting every other transverse grate element with the longitudinal support beam, support extensions connecting two of every three transverse grate elements with the longitudinal support beams, etc.

In the example structure shown in FIGS. 2A-2I, the longitudinal support beam 238 is connected to each end lug or the last transverse grate element 234 with a support extension 250 at the respective ends 240. The last support extensions 250 adjacent the ends 240 of grate 230 are shown as partially extending over discharge openings 214A. In addition support extensions 250 are shown as generally having the same width as transverse grate elements 234. It is not a requirement for the support extension to have the same width as transverse grate elements 234 or for the last support extensions 250 to partially extend over discharge openings 214A. In some cases it may be desirable to alter the shape of support extensions 250, to have the support extensions generally wider than transverse grate elements 234, or to have the support extensions generally thinner than transverse grate elements 234. For example, in one alternative embodiment shown in FIG. 5 grate 530 is provided with a longitudinal support beam 538 that is connected along its longitudinal length to transverse grate elements 534 by support extensions 550 extending outward from the transverse grate elements 534. The support extensions 550 extending from the last transverse grate elements 534 at the ends 540 of grate 530 are thinner than transverse grate elements 534. In addition, each support extension 550 has a base connected to the transverse grate elements that is substantially clear of discharge openings 514A to allow the material to flow more easily through the grate. As previously stated, while grate 530 is shown with only two support extensions 550 that are thinner than the transverse grate elements 534 it is also possible for additional support extensions 550 to be generally thinner than the transverse grate elements 534.

Although preferred embodiments are described above, other arrangements are possible for grates and grate components in accordance with the invention. Different aspects of the invention can be used in isolation to achieve some of the benefits of the invention. A variety of different configurations could be used to form the grate openings 214A, the end supports 240, the longitudinal support beam 238, the grate elements 236*a*, 236*b*, 234, and other disclosed features. Any combination of described features that performs at least some portion of the disclosed functions and/or provides at least some portion of the disclosed advantages falls within the scope of this specification. While a grate component with a single beam and two longitudinal grate elements (a so-called "double grate component") is preferred, aspects of the invention are usable with grate components provided with a single beam and a single longitudinal grate element (a so-called "single grate component"), or double grate components with two support beams and two longitudinal grate elements. Further, the invention encompasses other arrangements of a discharge grate component where there are less support beams than longitudinal grate elements, such as a grate component with one or two support beams and three longitudinal grate elements.

CONCLUSION

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the example structures described above without departing from the scope of the present invention.

The invention claimed is:

1. A discharge grate component for use in forming a discharge grate in a reducing machine, the discharge grate component comprising:

only two spaced apart longitudinal grate elements;

a plurality of spaced apart transverse grate elements that intersect the two longitudinal grate elements to define a curved working surface and form a plurality of discharge openings; and only one longitudinal support beam positioned outward of the intersecting longitudinal and transverse grate elements to provide support for the discharge grate component;

wherein the two spaced apart longitudinal grate elements, the plurality of spaced apart transverse grate elements and the one longitudinal support beam are fixed together for assembly as a unit into the reducing machine.

2. A discharge grate component in accordance with claim 1 wherein a plurality of openings extends transversely through the longitudinal support beam to enable flow-through of material from the discharge openings.

3. A discharge grate component in accordance with claim 1 wherein the longitudinal support beam has an arched structure.

4. A discharge grate component in accordance with claim 1 wherein each of the two spaced apart longitudinal grate elements and the longitudinal support beam have an angular orientation relative to a radial direction relative to the radius of curvature, and the angular orientation of the longitudinal support beam is independent of the angular orientation of the two spaced apart longitudinal grate elements.

5. A discharge grate component in accordance with claim 1 wherein each of the plurality of spaced apart transverse grate elements have support extensions that extend beyond an exterior surface of one of the at least two spaced apart longitudinal grate elements and the longitudinal support beam connects to each of the support extensions.

6. A discharge grate component in accordance with claim 1 including two adjacent exterior transverse grate elements that extend transversely beyond one side of at least one of the two spaced apart longitudinal grate elements such that the two adjacent exterior transverse grate elements form one-half of an exterior discharge opening with said one side of the respective longitudinal grate element.

7. A discharge grate component in accordance with claim 6 wherein the two adjacent exterior transverse grate elements align with the plurality of spaced apart transverse grate elements.

8. A discharge grate for use in a reducing machine, the discharge grate comprising:

at least two spaced apart longitudinal grate elements;

a plurality of spaced apart transverse grate elements that intersect the at least two of the longitudinal grate elements define a curved working surface and form a plurality of discharge openings;

two adjacent exterior transverse grate elements that extend transversely beyond one side of at least one of the longitudinal grate elements such that the two adjacent exterior transverse grate elements form one-half of an exterior discharge openings with said one side of the respective longitudinal grate element, wherein the two adjacent exterior transverse grate elements are offset from the transverse grate elements; and at least one longitudinal support beam positioned outward of the intersecting longitudinal and transverse grate elements to provide support for the discharge grate;

wherein the discharge grate has more of the at least two spaced apart longitudinal grate elements than the at least one longitudinal support beam.

9. A discharge grate for use in a reducing machine, the discharge grate comprising:

at least one longitudinal grate element;

a plurality of spaced apart transverse grate elements that intersect the at least one longitudinal grate element to define discharge openings; and at least one longitudinal support beam positioned outward of the intersecting longitudinal and transverse grate elements to provide support for the discharge grate;

wherein a plurality of openings extends transversely through the at least one longitudinal support beam between the intersecting longitudinal and transverse grate elements and the at least one longitudinal support beam.

10. A discharge grate in accordance with claim 9 wherein the at least one longitudinal grate element and the plurality of spaced apart transverse grate elements collectively define a curved working surface, and the at least one longitudinal support beam has an arched structure.

11. A discharge grate in accordance with claim 9 wherein the at least one longitudinal grate element and the plurality of spaced apart transverse grate elements collectively define a curved working surface defined by a radius of curvature, each of said at least one longitudinal grate elements and each said at least one longitudinal support beam has an angular orientation relative to a radial direction relative to the radius of curvature, and the angular orientation of each said longitudinal support beam is independent of the angular orientation of each said at least one longitudinal grate element.

12. A material reducing machine, the material reducing machine comprising:

a reducing chamber;

a material inlet system for feeding material into the reducing chamber;

a rotary head having a drive shaft and hammers to reduce the material fed into the reducing chamber; and a discharge grate, the discharge grate including multiple discharge grate components, each of the discharge grate components including:

only two spaced apart longitudinal grate elements;

a plurality of spaced apart transverse grate elements that intersect the two longitudinal grate elements to form a plurality of discharge openings; and only one longitudinal support beam positioned outward of the intersecting longitudinal and transverse grate elements to provide support for the discharge grate component;

wherein the two spaced apart longitudinal grate elements, the plurality of spaced apart transverse grate elements and the longitudinal support beam are fixed together for assembly as a unit into the reducing machine.

13. A material reducing machine in accordance with claim 12 wherein the longitudinal grate elements of at least one of the discharge grate components have an angular orientation relative to a radial direction of the drive shaft that is different than an angular orientation of the longitudinal grate elements of another discharge grate component.

14. A material reducing machine in accordance with claim 12 wherein the discharge grate has a first discharge grate component with a first longitudinal grate element and an adjacent discharge grate component with a second longitudinal grate element, the first longitudinal grate element and second longitudinal grate element each have an outer surface facing away from the drive shaft, and the first longitudinal grate element and the second longitudinal grate element are spaced apart from each other with an angle formed by radial rays extending from the drive shaft to the outer surface of each first and second longitudinal grate element, and the angle between the first and second adjacent longitudinal grate elements is greater than or equal to 8 degrees.

15. A material reducing machine in accordance with claim 12 wherein the discharge grate has a total number of discharge grate components N that includes a first discharge grate component with an outer edge closest to the inlet system and a last discharge grate component rotationally spaced from the first discharge grate component with an opposite outer edge, a radial ray extending from the drive shaft to the outer edge of the first discharge grate component and a radial ray extending from the drive shaft to the opposite outer edge of the last discharge grate component form an angle X, each discharge grate component has a longitudinal grate element with an outer surface generally facing away from the drive shaft, and each of the two spaced apart longitudinal grate element is spaced apart from an adjacent longitudinal grate element with an angle formed by radial rays extending from the drive shaft to the outer surfaces of each adjacent longitudinal grate element, and the angle between the adjacent longitudinal grate elements is about X/N.

16. A material reducing machine in accordance with claim 12 wherein a plurality of openings extends transversely through the one longitudinal support beam of each of the discharge grate components to enable flow-through of material from the discharge openings.

17. A material reducing machine in accordance with claim 12 wherein for each of the discharge grate components, the two spaced apart longitudinal grate elements and the plurality of spaced apart transverse grate elements collectively define a curved working surface, and the one longitudinal support beam has an arched structure.

18. A material reducing machine in accordance with claim 12 wherein for each of the discharge grate components, the two spaced apart longitudinal grate elements and the plurality of spaced apart transverse grate elements collectively define a curved working surface defined by a radius of curvature, each of the two spaced apart longitudinal grate elements and the one longitudinal support beam have an angular orientation relative to a radial direction relative to the radius of curvature, and the angular orientation of the one longitudinal support beam is independent of the angular orientation of the two spaced apart longitudinal grate elements.

19. A material reducing machine in accordance with claim 12 wherein for each of the discharge grate components, each of the plurality of spaced apart transverse grate elements have a support extension that extends beyond an exterior surface of one of the at least two spaced apart longitudinal grate elements and the one longitudinal support beam connects to of each of the support extensions.

20. A material reducing machine, the material reducing machine comprising:

a reducing chamber;

a material inlet system for feeding material into the reducing chamber;

a rotary head having a drive shaft and hammers to reduce the material fed into the reducing chamber; and a discharge grate, the discharge grate including multiple discharge grate components, each of the discharge grate components including:

at least one longitudinal grate element;

a plurality of spaced apart transverse grate elements that intersect the at least one longitudinal grate element; and at least one longitudinal support beam positioned outward of the intersecting at least one longitudinal grate element and transverse grate elements to provide support for the discharge grate;

wherein a plurality of openings extends transversely through the at least one longitudinal support beam between the intersecting longitudinal and transverse grate elements and the at least one longitudinal support beam.

* * * * *